US010760266B2

(12) United States Patent
Sacks et al.

(10) Patent No.: US 10,760,266 B2
(45) Date of Patent: Sep. 1, 2020

(54) VARIED LENGTH METAL STUDS

(71) Applicant: Clarkwestern Dietrich Building Systems LLC, West Chester, OH (US)

(72) Inventors: Abraham Jacob Sacks, Vancouver (CA); William Spilchen, Surrey (CA); Jeffrey Sacks, Vancouver (CA); Narcis Rugina, Vancouver (CA)

(73) Assignee: Clarkwestern Dietrich Building Systems LLC, West Chester, OH (US)

( * ) Notice: Subject to any disclaimer, the term of this patent is extended or adjusted under 35 U.S.C. 154(b) by 0 days.

(21) Appl. No.: 16/045,571

(22) Filed: Jul. 25, 2018

(65) Prior Publication Data

US 2019/0048583 A1 Feb. 14, 2019

Related U.S. Application Data

(60) Provisional application No. 62/545,366, filed on Aug. 14, 2017.

(51) Int. Cl.

| | |
|---|---|
| ***E04B 2/62*** | (2006.01) |
| ***E04C 3/32*** | (2006.01) |
| *E04C 3/08* | (2006.01) |
| *E04C 3/04* | (2006.01) |

(Continued)

(52) U.S. Cl.

CPC ..... *E04B 2/62* (2013.01); *E04C 3/32* (2013.01); *E04B 2/789* (2013.01); *E04B 2002/7488* (2013.01); *E04C 3/08* (2013.01); *E04C 2003/0413* (2013.01);

(Continued)

(58) Field of Classification Search

CPC ... E04B 2/62; E04B 2/789; E04C 3/32; E04C 2003/0491; E04C 2003/0473; E04C 2003/0413; E04C 3/08

USPC ..... 52/633.638, 647, 648.1, 650.1, 653.1, 52/654.1, 655.1; 29/896.7, 897.3–897.35

See application file for complete search history.

(56) References Cited

U.S. PATENT DOCUMENTS

| | | | |
|---|---|---|---|
| 320,163 | A | 6/1885 | Oh |
| 528,931 | A | 11/1894 | Eils |
| 553,306 | A | 1/1896 | Fordyce |

(Continued)

FOREIGN PATENT DOCUMENTS

| | | | |
|---|---|---|---|
| CA | 2391269 | A1 | 1/2003 |
| CA | 2652919 | A1 | 5/2010 |

(Continued)

OTHER PUBLICATIONS

Andrade, A., et al, "Lateral-torsional buckling of singly symmetric web-tapered thin-walled I-beams: ID model vs. shell FEA," *Computers and Structures,* 85:1343-1359, 2007, 17 pgs.

(Continued)

*Primary Examiner* — Brian E Glessner
*Assistant Examiner* — Adam G Barlow
(74) *Attorney, Agent, or Firm* — Frost Brown Todd LLC

(57) ABSTRACT

A stud such as a light-weight metal stud can include a first elongated channel member and a second elongated channel member coupled to the first elongated channel member by a wire matrix, where ends of the wire matrix are located at ends of the first and second channel members. A pitch of the wire matrix can vary over the length of the stud. Two or more such studs can have different lengths where a difference in the lengths is not a multiple of the pitch.

22 Claims, 17 Drawing Sheets

(51) Int. Cl.
*E04B 2/78* (2006.01)
*E04B 2/74* (2006.01)

(52) U.S. Cl.
CPC ..... *E04C 2003/0434* (2013.01); *E04C 2003/0473* (2013.01); *E04C 2003/0491* (2013.01)

(56) References Cited

U.S. PATENT DOCUMENTS 600,352 A 3/1898 Bell
617,458 A 1/1899 Clancy
651,590 A 6/1900 Brightman
659,416 A 10/1900 Perry
D35,386 S 12/1901 Reid
729,039 A 5/1903 Hollinger
749,714 A 1/1904 Barnes et al.
930,350 A 8/1909 Clark
934,081 A 9/1909 Marks
945,656 A 1/1910 White
948,414 A 2/1910 Clark
987,374 A 3/1911 Kahn
1,059,710 A 4/1913 Chess, Jr.
1,087,511 A 2/1914 Scammell
1,146,999 A 7/1915 Burk
1,147,000 A 7/1915 Burk
1,276,764 A 8/1918 Holbrook, Sr.
1,314,777 A 9/1919 White
1,363,018 A 12/1920 Sexton
1,372,741 A 3/1921 Dickinson
1,405,579 A 2/1922 Graham
1,419,709 A 6/1922 Ackermann
1,434,915 A 11/1922 Scholfield
1,436,866 A 11/1922 Dickinson
1,526,463 A 2/1925 Dawson et al.
1,537,588 A 5/1925 Curtis
1,591,858 A 7/1926 McClintic
1,637,410 A 8/1927 Coryell
1,641,872 A 9/1927 Southwell
1,655,091 A 1/1928 Curtis
1,691,227 A 11/1928 Cross
1,701,125 A 2/1929 Sagendorph
1,704,608 A 3/1929 Humphris
1,743,800 A 1/1930 Pearce
1,767,814 A 6/1930 Reynolds
1,769,361 A 7/1930 Warren
1,801,530 A 4/1931 Overmire
1,802,779 A 4/1931 Quade
1,824,082 A 9/1931 Hernandez
1,837,393 A 12/1931 Arey
1,879,295 A 9/1932 Kahn
1,885,343 A 11/1932 Greulich
1,897,842 A 2/1933 Herbest, Jr.
1,963,395 A 6/1934 Zabriskie
1,964,403 A 6/1934 Loucks
1,976,395 A 10/1934 Herbest, Jr.
1,986,171 A 1/1935 Wilson
1,986,172 A 1/1935 Wilson
1,993,432 A 3/1935 Boyle
2,022,363 A 11/1935 Vertuno
2,089,023 A 8/1937 Hahn
2,099,709 A 11/1937 Spinosa
2,101,074 A 12/1937 Kotrbaty
2,116,668 A 5/1938 Cross
2,121,962 A 6/1938 Glass
2,131,670 A 9/1938 Redding et al.
2,136,071 A 11/1938 Braden
2,141,400 A 12/1938 Mack
2,150,606 A 3/1939 McLellan
2,180,486 A 11/1939 Tench
2,184,353 A 12/1939 Leary
2,218,007 A 10/1940 Miller
2,219,806 A 10/1940 Buttress
2,236,141 A 3/1941 Karelius
2,241,991 A 5/1941 Goldsmith
2,243,723 A 5/1941 Tench
2,256,394 A 9/1941 Lamel
2,267,401 A 12/1941 Gilmore
2,269,869 A 1/1942 Specht
2,315,687 A 4/1943 Burke
2,322,654 A 6/1943 Moore
2,322,657 A 6/1943 Olsen
2,375,303 A 5/1945 Karelius
2,455,666 A 12/1948 Fournier
2,474,778 A 6/1949 Cross
2,501,699 A 3/1950 Stecker
2,565,292 A 8/1951 Arthur
2,572,483 A 10/1951 Howle
2,595,465 A 5/1952 Keene et al.
2,605,867 A 8/1952 Goodwin
2,621,160 A 12/1952 Johnson et al.
2,639,269 A 5/1953 Dube
2,645,824 A 7/1953 Titsworth
2,645,930 A 7/1953 Stockton
2,650,171 A 8/1953 Schaaf
2,668,606 A 2/1954 King
2,824,022 A 2/1958 Sucetti
2,903,880 A 9/1959 Johnson
2,929,239 A 3/1960 Dahlhauser et al.
2,936,051 A 5/1960 Martin
2,996,160 A 8/1961 Voight
3,070,198 A 12/1962 Haskell
3,073,066 A 1/1963 Edwards et al.
3,097,832 A 7/1963 Murdock et al.
3,145,001 A 8/1964 Bruninga
3,276,096 A 10/1966 McAleer et al.
3,299,785 A 1/1967 James
3,304,680 A 2/1967 Birdwell
3,342,003 A 9/1967 Frank
3,363,371 A 1/1968 Villalobos
3,461,636 A 8/1969 Hern
3,475,876 A 11/1969 Oroschakoff
3,503,590 A 3/1970 Buysens
3,522,685 A 8/1970 Oroschakoff
3,581,649 A 6/1971 Rauenhorst
3,600,868 A 8/1971 Wilson, Jr. et al.
3,660,215 A 5/1972 Pawlicki
3,672,022 A 6/1972 York
3,757,485 A 9/1973 Vincens
3,769,065 A 10/1973 Dunn
3,789,747 A 2/1974 Wasserman et al.
3,831,333 A 8/1974 Nelsson et al.
3,947,936 A 4/1976 Wheadon
3,991,536 A 11/1976 Rutherford
4,000,241 A 12/1976 Dunn
4,003,178 A 1/1977 Douthwaite
4,011,704 A 3/1977 O'Konski
4,020,612 A 5/1977 Welch
4,056,195 A 11/1977 Keith
4,085,558 A 4/1978 Albrecht
4,099,386 A 7/1978 Sagasta
4,159,302 A 6/1979 Greve et al.
4,179,264 A 12/1979 Vancauwenberghe
4,226,061 A 10/1980 Day, Jr.
4,245,926 A 1/1981 Asszonyi et al.
4,248,022 A 2/1981 Walker
4,255,489 A 3/1981 Nielsen
4,268,289 A 5/1981 Polaner
4,291,515 A 9/1981 Harding
4,297,866 A 11/1981 Sakauye et al.
4,343,127 A 8/1982 Greve et al.
4,347,155 A 8/1982 Jenkins
4,385,476 A 5/1983 Slager
4,396,685 A 8/1983 Jury
4,447,380 A 5/1984 Shannon et al.
4,464,885 A 8/1984 Palacio
4,485,606 A 12/1984 Gottlieb
4,510,727 A 4/1985 Jury
4,512,736 A 4/1985 Wader
4,513,551 A 4/1985 Gauffin et al.
4,520,073 A 5/1985 Randolph et al.
4,522,860 A 6/1985 Scott et al.
4,525,388 A 6/1985 Rehder et al.
4,539,787 A 9/1985 Ritter et al.
4,545,170 A 10/1985 Shirey

(56) References Cited

U.S. PATENT DOCUMENTS 4,551,957 A 11/1985 Madray
4,558,552 A 12/1985 Reitter, II
4,559,749 A 12/1985 Nusbaum
4,559,752 A 12/1985 Kieffer
4,571,914 A 2/1986 Stoyanoff
4,580,379 A 4/1986 Nusbaum
4,621,397 A 11/1986 Schrenk
4,658,552 A 4/1987 Mulford
4,669,243 A 6/1987 Gore et al.
4,691,493 A 9/1987 Larsen
4,693,048 A 9/1987 Guetersloh
4,695,033 A 9/1987 Imaeda et al.
4,713,921 A 12/1987 Minialoff et al.
4,720,957 A 1/1988 Madray
4,722,861 A 2/1988 Sawaide
4,734,337 A 3/1988 Patton
4,748,786 A 6/1988 Hannah
4,793,113 A 12/1988 Bodnar
4,803,128 A 2/1989 Bender
4,819,395 A 4/1989 Sugita et al.
4,841,705 A 6/1989 Fuhrer
4,843,786 A 7/1989 Walkinshaw et al.
4,893,569 A 1/1990 Hansen
4,897,007 A 1/1990 Chen et al.
4,968,185 A 11/1990 Leibhard et al.
5,002,696 A 3/1991 White
5,027,572 A 7/1991 Purcell et al.
5,029,779 A 7/1991 Bruggeman
5,081,814 A 1/1992 Singletary et al.
5,157,883 A 10/1992 Meyer
5,157,887 A 10/1992 Watterworth, III
5,231,811 A 8/1993 Andrepont et al.
5,249,400 A 10/1993 Turner
5,287,673 A 2/1994 Kreikemeier
5,305,941 A 4/1994 Kent et al.
5,321,928 A 6/1994 Warneke
5,360,771 A 11/1994 Delvaux et al.
5,363,621 A 11/1994 Kroll et al.
5,410,852 A 5/1995 Edgar et al.
5,418,013 A 5/1995 Detrick et al.
5,439,518 A 8/1995 Francis et al.
5,481,843 A 1/1996 Kreikemeier
5,519,978 A 5/1996 Sucato et al.
5,524,410 A 6/1996 Menchetti
5,527,590 A 6/1996 Priluck
5,528,876 A * 6/1996 Lu ..... E04G 9/065 52/654.1
5,529,192 A 6/1996 Conen et al.
5,540,023 A 7/1996 Jaenson
5,551,135 A 9/1996 Powers, III
5,570,953 A 11/1996 DeWall
5,590,505 A 1/1997 Bogle
5,592,800 A 1/1997 Koo
5,605,024 A 2/1997 Sucato et al.
5,617,686 A 4/1997 Gallagher, Jr.
5,625,995 A 5/1997 Martin
5,685,116 A 11/1997 Bradshaw et al.
5,697,195 A 12/1997 Maylon
5,716,718 A 2/1998 Lai
5,732,520 A 3/1998 Maietta
5,753,036 A 5/1998 Hornaman et al.
5,755,545 A 5/1998 Banks
5,761,864 A 6/1998 Nonoshita
5,761,873 A 6/1998 Slater
5,778,626 A 7/1998 Hellsten
5,826,388 A 10/1998 Irving
5,836,135 A 11/1998 Hagan et al.
5,842,276 A 12/1998 Asher et al.
5,845,379 A 12/1998 Steffensen
5,852,908 A 12/1998 Nankin
5,867,949 A 2/1999 Untiedt
5,867,962 A * 2/1999 Scott ..... E04C 3/292 52/696
5,927,035 A 7/1999 Haytayan
5,937,600 A 8/1999 Larson
5,943,775 A 8/1999 Lanahan et al.
5,979,131 A 11/1999 Remmele et al.
5,979,787 A 11/1999 Scarpa
5,984,563 A 11/1999 Wu
6,035,595 A 3/2000 Anderson
6,047,510 A 4/2000 Gallaway
6,050,048 A 4/2000 Hellsten
6,052,959 A 4/2000 LaBrosse
6,108,991 A 8/2000 Hagan et al.
6,115,898 A 9/2000 Sawdon
6,149,701 A 11/2000 Ellingson
6,205,740 B1 3/2001 Ekerholm et al.
6,207,256 B1 3/2001 Tashiro
6,254,981 B1 7/2001 Castle
6,263,629 B1 7/2001 Brown, Jr.
6,305,432 B1 10/2001 Sacks et al.
6,330,777 B1 * 12/2001 Padley ..... B21D 47/04 108/51.11
6,343,452 B1 2/2002 Holden
6,363,679 B1 4/2002 Rutherford
6,390,438 B1 5/2002 McManus
6,412,249 B1 7/2002 Boyer et al.
6,430,890 B1 8/2002 Chiwhane et al.
6,447,928 B2 9/2002 Suitts
6,460,393 B1 10/2002 Sundhagen
6,481,175 B2 11/2002 Potter et al.
6,584,735 B2 7/2003 Burton
6,609,344 B2 8/2003 Saldana
6,617,386 B2 9/2003 Lelli et al.
6,658,809 B2 12/2003 Collins
6,668,501 B2 12/2003 Adebar et al.
6,718,702 B2 4/2004 Fuerle
6,754,997 B2 6/2004 Bonin
6,758,743 B1 7/2004 Grosskrueger
6,785,959 B2 9/2004 Sawdon et al.
6,820,387 B2 11/2004 Sacks et al.
6,823,636 B2 11/2004 Mahoney
6,880,294 B2 4/2005 Walters
6,910,311 B2 6/2005 Lindberg et al.
6,920,734 B2 7/2005 Elderson
6,923,195 B2 8/2005 Tseng
6,938,383 B2 9/2005 Morris et al.
6,993,883 B2 2/2006 Belanger
7,003,861 B2 2/2006 Sawdon et al.
7,117,649 B2 10/2006 Morris et al.
7,143,551 B2 12/2006 Corwin
7,174,688 B2 2/2007 Higginbotham
7,179,165 B2 2/2007 Cook
7,195,556 B1 3/2007 Fichtelman
7,231,746 B2 6/2007 Bodnar
7,287,356 B2 10/2007 Sacks et al.
7,368,175 B2 5/2008 Neth
7,381,261 B1 6/2008 Nelson
7,497,903 B2 3/2009 Wang et al.
7,517,590 B2 4/2009 Wagner
7,538,152 B2 5/2009 Bohler et al.
7,565,775 B2 7/2009 Cooper et al.
7,604,534 B2 10/2009 Hill
7,654,051 B2 2/2010 Pollack
7,690,167 B2 4/2010 Antonic
7,694,399 B2 4/2010 Sawdon et al.
7,735,294 B2 6/2010 Moody et al.
7,788,868 B2 9/2010 Pollack
7,820,302 B2 10/2010 Krettenauer
7,823,361 B2 * 11/2010 Powers, III ..... F16L 3/24 248/49
7,861,488 B2 1/2011 Giles et al.
7,866,112 B2 1/2011 Edmondson
7,921,537 B2 4/2011 Rodlin
7,955,460 B2 6/2011 Bennett, III et al.
8,074,416 B2 12/2011 Andrews
8,084,117 B2 12/2011 Lalvani
8,171,696 B2 * 5/2012 Powers, III ..... E04C 3/07 52/650.1
8,225,581 B2 7/2012 Strickland et al.
8,234,836 B2 8/2012 Anderson
8,276,321 B2 10/2012 Bell
8,281,551 B2 10/2012 Leek et al.
8,359,813 B2 1/2013 Bodnar

(56) References Cited

U.S. PATENT DOCUMENTS

| | | | | |
|---|---|---|---|---|
| 8,499,514 | B2 * | 8/2013 | Farrell, Jr. | E04B 2/845 52/371 |
| 8,578,576 | B2 | 11/2013 | Castricum | |
| 8,608,533 | B2 | 12/2013 | Daniels | |
| 8,615,957 | B1 * | 12/2013 | Sacks | E04B 5/10 52/647 |
| 8,650,730 | B2 | 2/2014 | Sawdon | |
| 8,677,716 | B2 | 3/2014 | Anderson | |
| 8,696,781 | B2 | 4/2014 | Wallner et al. | |
| 8,720,142 | B2 | 5/2014 | Spilchen | |
| 8,745,959 | B2 | 6/2014 | Strickland et al. | |
| 8,763,347 | B2 | 7/2014 | Anderson et al. | |
| 9,174,264 | B2 | 11/2015 | Anderson | |
| 9,376,816 | B2 | 6/2016 | Anderson et al. | |
| 9,421,599 | B2 | 8/2016 | Sawdon et al. | |
| 9,708,816 | B2 | 7/2017 | Sacks et al. | |
| 9,752,323 | B2 * | 9/2017 | Sacks | E04C 3/32 |
| 10,197,297 | B2 | 2/2019 | Daniels, II et al. | |
| 10,328,481 | B2 | 6/2019 | Koenigbauer et al. | |
| 2003/0126806 | A1 | 7/2003 | Ellis | |
| 2005/0055953 | A1 | 3/2005 | Sacks et al. | |
| 2005/0108978 | A1 | 5/2005 | Strickland et al. | |
| 2005/0229523 | A1 | 10/2005 | Bodnar | |
| 2005/0241258 | A1 | 11/2005 | Shih | |
| 2006/0075715 | A1 | 4/2006 | Serpico et al. | |
| 2006/0265997 | A1 | 11/2006 | Collins, Jr. et al. | |
| 2007/0119106 | A1 | 5/2007 | Sacks et al. | |
| 2007/0175145 | A1 | 8/2007 | Sacks et al. | |
| 2007/0175149 | A1 | 8/2007 | Bodnar | |
| 2007/0193150 | A1 | 8/2007 | Carlson | |
| 2007/0243820 | A1 | 10/2007 | O'Hagin | |
| 2008/0250738 | A1 | 10/2008 | Howchin | |
| 2009/0013633 | A1 | 1/2009 | Aubuchon | |
| 2009/0165416 | A1 * | 7/2009 | Porter | E04B 2/7453 52/481.1 |
| 2009/0186570 | A1 | 7/2009 | Riggins | |
| 2009/0223167 | A1 | 9/2009 | Anderson | |
| 2010/0101404 | A1 | 4/2010 | Lorenzo et al. | |
| 2010/0287872 | A1 | 11/2010 | Bodnar | |
| 2010/0300645 | A1 | 12/2010 | Glover | |
| 2011/0021663 | A1 | 1/2011 | Sacks et al. | |
| 2012/0028563 | A1 | 2/2012 | Sacks et al. | |
| 2012/0186190 | A1 | 7/2012 | Powers, III et al. | |
| 2013/0333172 | A1 | 12/2013 | Wallner et al. | |
| 2015/0240486 | A1 | 8/2015 | Sacks et al. | |
| 2015/0308118 | A1 | 10/2015 | Spilchen et al. | |

FOREIGN PATENT DOCUMENTS

| | | | |
|---|---|---|---|
| CH | 658 489 | A5 | 11/1986 |
| DE | 40 19 281 | A1 | 12/1991 |
| EP | 0 374 316 | A1 | 6/1990 |
| EP | 0 579 007 | A2 | 1/1994 |
| EP | 0 637 658 | A1 | 2/1995 |
| EP | 0 691 441 | A1 | 1/1996 |
| FR | 2 421 695 | A1 | 11/1979 |
| FR | 2 584 957 | A1 | 1/1987 |
| GB | 311 636 | A | 5/1929 |
| GB | 414 277 | A | 8/1934 |
| GB | 1 329 865 | A | 9/1973 |
| GB | 2 201 184 | A | 8/1988 |
| JP | H07-233611 | A | 9/1992 |
| JP | H04-293848 | A | 10/1992 |
| JP | H11-181989 | A | 7/1999 |
| JP | 2001-065140 | A | 3/2001 |
| JP | 2002-292230 | A | 10/2002 |
| JP | 2003-013577 | A | 1/2003 |
| JP | 2003-024732 | A | 1/2003 |
| WO | WO 97/13936 | A1 | 4/1997 |
| WO | WO 00/53356 | A1 | 9/2000 |
| WO | WO 2010/059631 | A1 | 5/2010 |
| WO | WO 2012/024768 | A1 | 3/2012 |
| WO | WO 2017/015766 | A1 | 2/2017 |

OTHER PUBLICATIONS

Blomberg, T.R., et al., "Heat Transmission Through Walls with Slotted Steel Studs," *Thermal Envelope VII/Wall Systems—Principles,* pp. 621-628, 1998, 8 pages.

Dryvit Systems, Inc., "Demandit: Interior/Exterior Acrylic Coating in Standard and Custom Colors," 1990, 1 page.

Dryvit Systems, Inc., "Metallic Demandit: Interior/Exterior Acrylic Coating with a Metalic Appearance," 1989, 1 page.

Dryvit Systems, Inc., "Quarzite: Exterior and Interior Quartz Aggregate Finish," 1991, 1 page.

Hoglund, T., et al., "Slotted steel studs to reduce thermal bridges in insulated walls," *Thin-Walled Structures* 32:81-109, 1998, 29 pgs.

Katz, H.S. et al. (eds.) *Handbook of Fillers for Plastics,* Van Nostrand Reinhold, New York, 1987, pp. 441, 2 pgs.

National Association of Architectural Metal Manufactures, "Standards for Expanded Metal," NAAMM Standard, EMMA 557-99, 1999, 18 pages.

Wallner Tooling\Expac, Inc., "Decorative/Standard Patterns," retrieved on May 6, 2014, from http://www.expac.com/decorativepatterns.htm, 2 pages.

Wallner Tooling\Expac, Inc., "Expanded Metal & Pleated Filters for HVAC Industry," retrieved on May 6, 2014, from http://www._expac.com/hvac.htm, 1 page.

Wallner Tooling\Expac, Inc., "Glossary of Expanded Metal," retrieved on May 6, 2014, from http://www.expac.com/glossary.htm, 2 pages.

Wallner Tooling\Expac, Inc., "Standard Patterns," retrieved on May 6, 2014, from http://www.expac.com/standardportfolio.htm, 2 pages.

Sacks et al., "Twin Track Wire Lath," Office Action, dated Jun. 7, 2004, for U.S. Appl. No. 10/663,419, 12 pages.

Sacks et al., "Twin Track Wire Lath," Amendment, filed Oct. 25, 2004, for U.S. Appl. No. 10/663,419, 14 pages.

Sacks et al., "Twin Track Wire Lath," Office Action, dated Feb. 9, 2005, for U.S. Appl. No. 10/663,419, 10 pages.

Sacks et al., "Twin Track Wire Lath," Office Action, dated Sep. 12, 2005, for U.S. Appl. No. 10/663,419, 10 pages.

Sacks et al., "Twin Track Wire Lath," Amendment, filed Nov. 12, 2005, for U.S. Appl. No. 10/663,419, 12 pages.

Sacks et al., "Twin Track Wire Lath," Supplemental Amendment, filed Nov. 17, 2005, for U.S. Appl. No. 10/663,419, 19 pages.

Sacks et al., "Twin Track Wire Lath," Office Action, dated Sep. 5, 2006, for U.S. Appl. No. 10/663,419, 15 pages.

Sacks et al., "Twin Track Wire Lath," Amendment, filed Dec. 4, 2006, for U.S. Appl. No. 10/663,419, 22 pages.

Sacks et al., "Twin Track Wire Lath," Office Action, dated Feb. 9, 2007, for U.S. Appl. No. 10/663,419, 9 pages.

Sacks et al., "Twin Track Wire Lath," Amendment, filed Mar. 9, 2007, for U.S. Appl. No. 10/663,419, 13 pages.

Sacks et al., "Twin Track Wire Lath," Office Action, dated Apr. 10, 2007, for U.S. Appl. No. 10/663,419, 9 pages.

Sacks et al., "Twin Track Wire Lath," Amendment, filed Jun. 18, 2007, for U.S. Appl. No. 10/663,419, 6 pages.

Sacks et al., "Twin Track Wire Lath," Notice of Allowance, dated Jul. 26, 2007, for U.S. Appl. No. 10/663,419, 5 pages.

Sacks et al., "Lath With Barrier Material," Office Action, dated Feb. 3, 2010, for U.S. Appl. No. 11/679,562, 15 pages.

Sacks et al., "Lath With Barrier Material," Amendment, filed Apr. 29, 2010, for U.S. Appl. No. 11/679,562, 4 pages.

Sacks et al., "Lath With Barrier Material," Supplemental Amendment, filed Jun. 15, 2010, for U.S. Appl. No. 11/679,562, 5 pages.

Sacks et al., "Lath With Barrier Material," Office Action, dated Aug. 25, 2010, for U.S. Appl. No. 11/679,562, 13 pages.

Sacks et al., "Light Weight Aggregate Composition," Office Action, dated Nov. 23, 2010, for U.S. Appl. No. 12/508,384, 8 pages.

Sacks et al., "Energy Efficient Building Environmental Control Apparatus and Method," Preliminary Amendment, filed Sep. 15, 2010, for U.S. Appl. No. 12/847,923, 11 pages.

Sacks et al., "Energy Efficient Building Environmental Control Apparatus and Method," Office Action, dated Jul. 8, 2011, for U.S. Appl. No. 12/847,923, 17 pages.

(56) References Cited

OTHER PUBLICATIONS

Spilchen et al., "Stabilized Lath and Method of Manufacture," Office Action, dated Aug. 26, 2013, for U.S. Appl. No. 13/592,784, 11 pages.
Spilchen et al., "Stabilized Lath and Method of Manufacture," Amendment, filed Jan. 14, 2014, for U.S. Appl. No. 13/592,784, 33 pages.
Spilchen et al., "Stabilized Lath and Method of Manufacture," Notice of Allowance, dated Feb. 11, 2014, U.S. Appl. No. 13/592,784, 7 pages.
Sacks et al., "Light-Weight Metal Stud and Method of Manufacture," Office Action, dated May 14, 2013, for U.S. Appl. No. 13/767,764, 12 pages.
Sacks et al., "Light-Weight Metal Stud and Method of Manufacture," Amendment, filed Aug. 7, 2013, for U.S. Appl. No. 13/767,764, 17 pages.
Sacks et al., "Light-Weight Metal Stud and Method of Manufacture," Notice of Allowance, dated Aug. 21, 2013, for U.S. Appl. No. 13/767,764, 21 pages.
Sacks et al., "Light-Weight Metal Stud and Method of Manufacture," Notice of Allowance, dated Oct. 17, 2013, for U.S. Appl. No. 13/767,764, 4 pages.
Wallner et al., "Expanded Metal and Process of Making the Same," U.S. Appl. No. 13/970,472, filed Aug. 19, 2013, 27 pages.
Wallner et al., "Expanded Metal and Process of Making the Same," Preliminary Amendment, filed Oct. 16, 2013, for U.S. Appl. No. 13/970,472, 14 pages.
Sacks et al., "Framing Members to Enhance Thermal Characteristics of Walls," U.S. Appl. No. 14/189,548, filed Feb. 25, 2014, 68 pages.
Sacks et al., "Framing Members to Enhance Thermal Characteristics of Walls," Office Action, dated Oct. 9, 2014, for U.S. Appl. No. 14/189,548, 44 pages.
Sacks et al., "One Coat Stucco Lath and Method of Manufacture," Office Action, dated Sep. 8, 2014, for U.S. Appl. No. 14/292,542, 20 pages.
Sacks et al., "One Coat Stucco Lath and Method of Manufacture," Amendment, filed Mar. 6, 2015, for U.S. Appl. No. 14/292,542, 77 pages.
Sacks et al., "One Coat Stucco Lath and Method of Manufacture," Office Action, dated Mar. 18, 2015, for U.S. Appl. No. 14/292,542, 21 pages.
Sacks et al., "One Coat Stucco Lath and Method of Manufacture," Amendment, filed Sep. 18, 2015, for U.S. Appl. No. 14/292,542, 24 pages.
Sacks et al., "One Coat Stucco Lath and Method of Manufacture," Office Action, dated Oct. 2, 2015, for U.S. Appl. No. 14/292,542, 14 pages.
Sacks et al., "One Coat Stucco Lath and Method of Manufacture," Amendment, dated Mar. 24, 2016, for U.S. Appl. No. 14/292,542, 27 pages.
Sacks et al., "One Coat Stucco Lath and Method of Manufacture," Office Action, dated Apr. 26, 2016, for U.S. Appl. No. 14/292,542, 29 pages.
Sacks et al., "Framing Members to Enhance Thermal Characteristics of Walls," Office Action, dated Aug. 4, 2015, for U.S. Appl. No. 14/68L919, 28 pages.
Sacks et al., "Framing Members to Enhance Thermal Characteristics of Walls," Amendment, filed Nov. 4, 2015, for U.S. Appl. No. 14/681,919, 21 pages.
Sacks et al., "Framing Members to Enhance Thermal Characteristics of Walls," Office Acfion, dated Feb. 4, 2016, for U.S. Appl. No. 14/681,919, 21 pages.
Spilchen et al., "Reinforcing Insert Article, Kit and Method," Office Action, dated Sep. 18, 2015, for U.S. Appl. No. 14/795,731, 26 pages.
Spilchen et al., "Reinforcing Insert Article, Kit and Method," Amendment, filed Dec. 18, 2015, for U.S. Appl. No. 14/795,731, 21 pages.
Spilchen et al., "Reinforcing Insert Article, Kit and Method," Office Action, dated Mar. 18, 2016, for U.S. Appl. No. 14/795,731, 17 pages.
Sacks et al., "Light-Weight Metal Stud and Method of Manufacture," Office Action, dated Jan. 11, 2016, for U.S. Appl. No. 14/812,952, 14 pages.
Sacks et al., "Light-Weight Metal Stud and Method of Manufacture," Amendment, filed Apr. 8, 2016, for U.S. Appl. No. 14/812,952, 24 pages.
Sacks et al., "Light-Weight Metal Stud and Method of Manufacture," Office Action, dated May 2, 2016, for U.S. Appl. No. 14/812,952, 28 pages.
Spilchen et al., "Reinforcing Insert Article, Kit and Method," U.S. Appl. No. 61/903,513, filed Nov. 13, 2013, 39 pages.
Sacks et al., "Varied Length Metal Studs," U.S. Appl. No. 62/545,366, filed Aug. 14, 2017, 51 pages.
International Search Report, dated Sep. 30, 2016, for International Application No. PCT/CA2016/050900, 3pages.
International Preliminary Report on Patentability and Written Opinion dated Jan. 30, 2018 for Application No. PCT/CA2016/050900, 6 pgs.
International Search Report and Written Opinion dated Oct. 24, 2018 for Application No. PCT/CA2018/050901, 14 pgs.
International Search Report and Opinion, dated Feb. 9, 2011, for International Application No. PCT/US2010/050421, 10 pages.

* cited by examiner

VARIED LENGTH METAL STUDS

BACKGROUND

Technical Field

The present disclosure relates to structural members, and more particularly, to metal studs.

Description of the Related Art

Metal studs and framing members have been used in the areas of commercial and residential construction for many years. Metal studs offer a number of advantages over traditional building materials, such as wood. For instance, metal studs can be manufactured to have strict dimensional tolerances, which increase consistency and accuracy during construction of a structure. Moreover, metal studs provide dramatically improved design flexibility due to the variety of available sizes and thicknesses and variations of metal materials that can be used. Moreover, metal studs have inherent strength-to-weight ratios which allow them to span longer distances and better resist and transmit forces and bending moments.

BRIEF SUMMARY

The various embodiments described herein may provide a stud with enhanced thermal efficiency over more conventional studs. While metals are typically classed as good thermal conductors, the studs described herein employ various structures and techniques to reduce conductive thermal transfer thereacross. For instance, use of a wire matrix, welds such as resistance welds, and specific weld locations such as at peaks, apexes, or intersections of the wires in the wire matrix, may contribute to the overall energy efficiency of the stud.

It has been found that light-weight metal studs incorporating a wire matrix can be strengthened, or in some cases their rigidity or stability and can be increased, such as to increase web crippling strengths of the ends of the studs, by fabricating the studs so that ends of the wires in the wire matrix are located at and/or welded to ends of channel members of the studs.

It has also been found that the ability to manufacture studs to any specific length provides distinct advantages, such as improving the efficiency of installation of the studs at a work site. Thus, systems and methods have been developed that allow the continuous fabrication of metal studs having various lengths and having ends of wires in a wire matrix located at and/or welded to ends of channel members of the studs. Such methods generally include continuously fabricating a wire matrix and stretching the wire matrix to various degrees corresponding to the various lengths of the studs to be fabricated, before welding the wire matrix to channel members.

A light-weight metal stud may be summarized as comprising: a first elongated channel member, the first elongated channel member having a respective major face having a respective first edge along a major length thereof and a respective second edge along the major length thereof, a respective first flange extending along the first edge at a non-zero angle to the respective major face of the first elongated channel member, a respective second flange extending along the second edge at a non-zero angle to the respective major face of the first elongated channel member, a respective first end along the major length thereof, and a respective second end along the major length thereof, the first end of the first elongated channel member opposite to the second end of the first elongated channel member across the major length of the first elongated channel member; a second elongated channel member, the second elongated channel member having a respective major face having a respective first edge along a major length thereof and a respective second edge along the major length thereof, a respective first flange extending along the first edge at a non-zero angle to the respective major face of the second elongated channel member, a respective second flange extending along the second edge at a non-zero angle to the respective major face of the second elongated channel member, a respective first end along the major length thereof, and a respective second end along the major length thereof, the first end of the second elongated channel member opposite to the second end of the second elongated channel member across the major length of the second elongated channel member; a first continuous wire member having a plurality of bends to form alternating apexes along a respective length thereof, a respective first end along the respective length thereof, and a respective second end along the respective length thereof, the first end of the first continuous wire member opposite to the second end of the first continuous wire member across the length of the first continuous wire member, the apexes of the first continuous wire member alternatively physically attached to the first and the second elongated channel members along at least a portion of the first and the second elongated channel members, the first end of the first continuous wire member coupled to the first elongated channel member at the first end of the first elongated channel member, and the second end of the first continuous wire member coupled to either the first or the second elongated channel member at the second end of either the first or the second elongated channel member; and a second continuous wire member having a plurality of bends to form alternating apexes along a respective length thereof, a respective first end along the respective length thereof, and a respective second end along the respective length thereof, the first end of the second continuous wire member opposite to the second end of the second continuous wire member across the length of the second continuous wire member, the apexes of the second continuous wire member alternatively physically attached to the first and the second elongated channel members along at least a portion of the first and the second elongated channel members, the first end of the second continuous wire member coupled to the second elongated channel member at the first end of the second elongated channel member, the second end of the second continuous wire member coupled to the second end of either the first or the second elongated channel member, and the first and the second elongated channel members held in spaced apart parallel relation to one another by both of the first and the second wire members, with a longitudinal passage formed therebetween.

The first and the second wire members may be physically attached to one another at each point at which the first and the second wire members cross one another. Each of the apexes of the second wire member may be opposed to a respective one of the apexes of the first wire member across the longitudinal passage. The first and the second continuous wires may be physically attached to the respective first flange of both the first and the second elongated channel member by welds and do not physically contact the respective major faces of the first and the second elongated channel members. The welds may be resistance welds. The apexes of the first continuous wire member attached to the first elongated channel member may alternate with the apexes of the second continuous wire member attached to the first elongated channel member such that a difference between a largest distance between adjacent ones of the apexes of the first and second continuous wires attached to the first elongated channel member and a smallest distance between adjacent ones of the apexes of the first and second continuous wires attached to the first elongated channel member is at least 1% of a mean distance between adjacent ones of the apexes of the first and second continuous wires attached to the first elongated channel member. The first and second continuous wire members may be plastically deformed wire members. The first and second continuous wire members may carry residual stresses.

A light-weight metal stud may be summarized as comprising: a first elongated channel member, the first elongated channel member having a respective major face having a respective first edge along a major length thereof and a respective second edge along the major length thereof, a respective first flange extending along the first edge at a non-zero angle to the respective major face of the first elongated channel member, and a respective second flange extending along the second edge at a non-zero angle to the respective major face of the first elongated channel member; a second elongated channel member, the second elongated channel member having a respective major face having a respective first edge along a major length thereof and a respective second edge along the major length thereof, a respective first flange extending along the first edge at a non-zero angle to the respective major face of the second elongated channel member, and a respective second flange extending along the second edge at a non-zero angle to the respective major face of the second elongated channel member; a first continuous wire member having a plurality of bends to form alternating apexes along a respective length thereof, the apexes of the first continuous wire member alternatively physically attached to the first and the second elongated channel members along at least a portion of the first and the second elongated channel members; and a second continuous wire member having a plurality of bends to form alternating apexes along a respective length thereof, the apexes of the second continuous wire member alternatively physically attached to the first and the second elongated channel members along at least a portion of the first and the second elongated channel members, the apexes of the first continuous wire member attached to the first elongated channel member alternating with the apexes of the second continuous wire member attached to the first elongated channel member such that a difference between a largest distance between adjacent ones of the apexes of the first and second continuous wires attached to the first elongated channel member and a smallest distance between adjacent ones of the apexes of the first and second continuous wires attached to the first elongated channel member is at least 1% of a mean distance between adjacent ones of the apexes of the first and second continuous wires attached to the first elongated channel member, the first and the second elongated channel members held in spaced apart parallel relation to one another by both of the first and the second wire members, with a longitudinal passage formed therebetween.

A difference between a largest distance between adjacent ones of the apexes of the first and second continuous wires attached to the first elongated channel member and a smallest distance between adjacent ones of the apexes of the first and second continuous wires attached to the first elongated channel member may be at least 2%, 3%, or 5% of a mean distance between adjacent ones of the apexes of the first and second continuous wires attached to the first elongated channel member.

A method of making a light-weight metal stud may be summarized as comprising: providing a first elongated channel member having a respective major face having a respective first edge along a major length thereof and a respective second edge along the major length thereof, a respective first flange extending along the first edge at a non-zero angle to the respective major face of the first elongated channel member, and a respective second flange extending along the second edge at a non-zero angle to the respective major face of the first elongated channel member; providing a second elongated channel member having a respective major face having a respective first edge along a major length thereof and a respective second edge along the major length thereof, a respective first flange extending along the first edge at a non-zero angle to the respective major face of the second elongated channel member, and a respective second flange extending along the second edge at a non-zero angle to the respective major face of the second elongated channel member; tensioning a wire matrix including first and second continuous wire members, each of the first and second wire members having a plurality of bends to form alternating apexes along a respective length thereof; and coupling the first and the second elongated channel members together with the tensioned wire matrix, the apexes of the first continuous wire member alternatively physically attached to the first and the second elongated channel members along at least a portion of the first and the second elongated channel members, and the apexes of the second continuous wire member alternatively physically attached to the first and the second elongated channel members along at least a portion of the first and the second elongated channel members.

The method may further comprise physically attaching the first and the second continuous wire members to one another at intersection points thereof. The physically attaching the first and the second continuous wire members to one another at intersection points thereof may occur before the coupling the first and the second elongated channel members together by the wire matrix. Tensioning the wire matrix may include tensioning the wire matrix along a longitudinal axis of the wire matrix. Tensioning the wire matrix may include plastically and/or elastically deforming the wire matrix.

A plurality of studs may be summarized as comprising: a first light weight stud having a first length, the first stud including: a first elongated channel member, the first elongated channel member having a respective major face having a respective first edge along a major length thereof and a respective second edge along the major length thereof, a respective first flange extending along the first edge at a non-zero angle to the respective major face of the first elongated channel member, a respective second flange extending along the second edge at a non-zero angle to the respective major face of the first elongated channel member, a respective first end along the major length thereof, and a respective second end along the major length thereof, the first end of the first elongated channel member opposite to the second end of the first elongated channel member across the major length of the first elongated channel member; a second elongated channel member, the second elongated channel member having a respective major face having a respective first edge along a major length thereof and a respective second edge along the major length thereof, a respective first flange extending along the first edge at a non-zero angle to the respective major face of the second elongated channel member, a respective second flange extending along the second edge at a non-zero angle to the respective major face of the second elongated channel member, a respective first end along the major length thereof, and a respective second end along the major length thereof, the first end of the second elongated channel member opposite to the second end of the second elongated channel member across the major length of the second elongated channel member; a first continuous wire member having a plurality of bends to form alternating apexes along a respective length thereof, a respective first end along the respective length thereof, and a respective second end along the respective length thereof, the first end of the first continuous wire member opposite to the second end of the first continuous wire member across the length of the first continuous wire member, the apexes of the first continuous wire member alternatively physically attached to the first and the second elongated channel members along at least a portion of the first and the second elongated channel members, the first end of the first continuous wire member coupled to the first end of the first elongated channel member, and the second end of the first continuous wire member coupled to the second end of either the first or the second elongated channel member; and a second continuous wire member having a plurality of bends to form alternating apexes along a respective length thereof, a respective first end along the respective length thereof, and a respective second end along the respective length thereof, the first end of the second continuous wire member opposite to the second end of the second continuous wire member across the length of the second continuous wire member, the apexes of the second continuous wire member alternatively physically attached to the first and the second elongated channel members along at least a portion of the first and the second elongated channel members, the first end of the second continuous wire member coupled to the first end of the second elongated channel member, the second end of the second continuous wire member coupled to the second end of either the first or the second elongated channel member, the apexes of the first continuous wire member attached to the first elongated channel member spaced apart from adjacent apexes of the second continuous wire member attached to the first elongated channel member by a first pitch, and the first and the second elongated channel members held in spaced apart parallel relation to one another by both of the first and the second wire members, with a longitudinal passage formed therebetween; and a second light weight stud having a second length, the second stud including: a third elongated channel member, the third elongated channel member having a respective major face having a respective first edge along a major length thereof and a respective second edge along the major length thereof, a respective first flange extending along the first edge at a non-zero angle to the respective major face of the third elongated channel member, a respective second flange extending along the second edge at a non-zero angle to the respective major face of the third elongated channel member, a respective first end along the major length thereof, and a respective second end along the major length thereof, the first end of the third elongated channel member opposite to the second end of the third elongated channel member across the major length of the third elongated channel member; a fourth elongated channel member, the fourth elongated channel member having a respective major face having a respective first edge along a major length thereof and a respective second edge along the major length thereof, a respective first flange extending along the first edge at a non-zero angle to the respective major face of the fourth elongated channel member, a respective second flange extending along the second edge at a non-zero angle to the respective major face of the fourth elongated channel member, a respective first end along the major length thereof, and a respective second end along the major length thereof, the first end of the fourth elongated channel member opposite to the second end of the fourth elongated channel member across the major length of the fourth elongated channel member; a third continuous wire member having a plurality of bends to form alternating apexes along a respective length thereof, a respective first end along the respective length thereof, and a respective second end along the respective length thereof, the first end of the third continuous wire member opposite to the second end of the third continuous wire member across the length of the third continuous wire member, the apexes of the third continuous wire member alternatively physically attached to the third and the fourth elongated channel members along at least a portion of the third and the fourth elongated channel members, the first end of the third continuous wire member coupled to the first end of the third elongated channel member, and the second end of the third continuous wire member coupled to the second end of either the third or the fourth elongated channel member; and a fourth continuous wire member having a plurality of bends to form alternating apexes along a respective length thereof, a respective first end along the respective length thereof, and a respective second end along the respective length thereof, the first end of the fourth continuous wire member opposite to the second end of the fourth continuous wire member across the length of the fourth continuous wire member, the apexes of the fourth continuous wire member alternatively physically attached to the third and the fourth elongated channel members along at least a portion of the third and the fourth elongated channel members, the first end of the fourth continuous wire member coupled to the first end of the fourth elongated channel member, the second end of the fourth continuous wire member coupled to the second end of either the third or the fourth elongated channel member, the apexes of the third continuous wire member attached to the third elongated channel member spaced apart from adjacent apexes of the fourth continuous wire member attached to the third elongated channel member by a second pitch, and the third and the fourth elongated channel members held in spaced apart parallel relation to one another by both of the third and the fourth wire members, with a longitudinal passage formed therebetween; wherein the first length differs from the second length and the first pitch differs from the second pitch.

The first length may differ from the second length by an amount that is not a multiple of either the first pitch or the second pitch. The first length may differ from the second length by 1 inch. The first length may differ from the second length by less than ½ inch.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements, and may have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with the technology have not been shown or described in detail to avoid unnecessarily obscuring descriptions of the embodiments.

Unless the context requires otherwise, throughout the specification and claims that follow, the word "comprising" is synonymous with "including," and is inclusive or open-ended (i.e., does not exclude additional, un-recited elements or method acts).

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the context clearly dictates otherwise. It should also be noted that the term "or" is generally employed in its broadest sense, that is, as meaning "and/or" unless the context clearly dictates otherwise.

The headings and Abstract of the Disclosure provided herein are for convenience only and do not limit the scope or meaning of the embodiments.

Figure 1A:
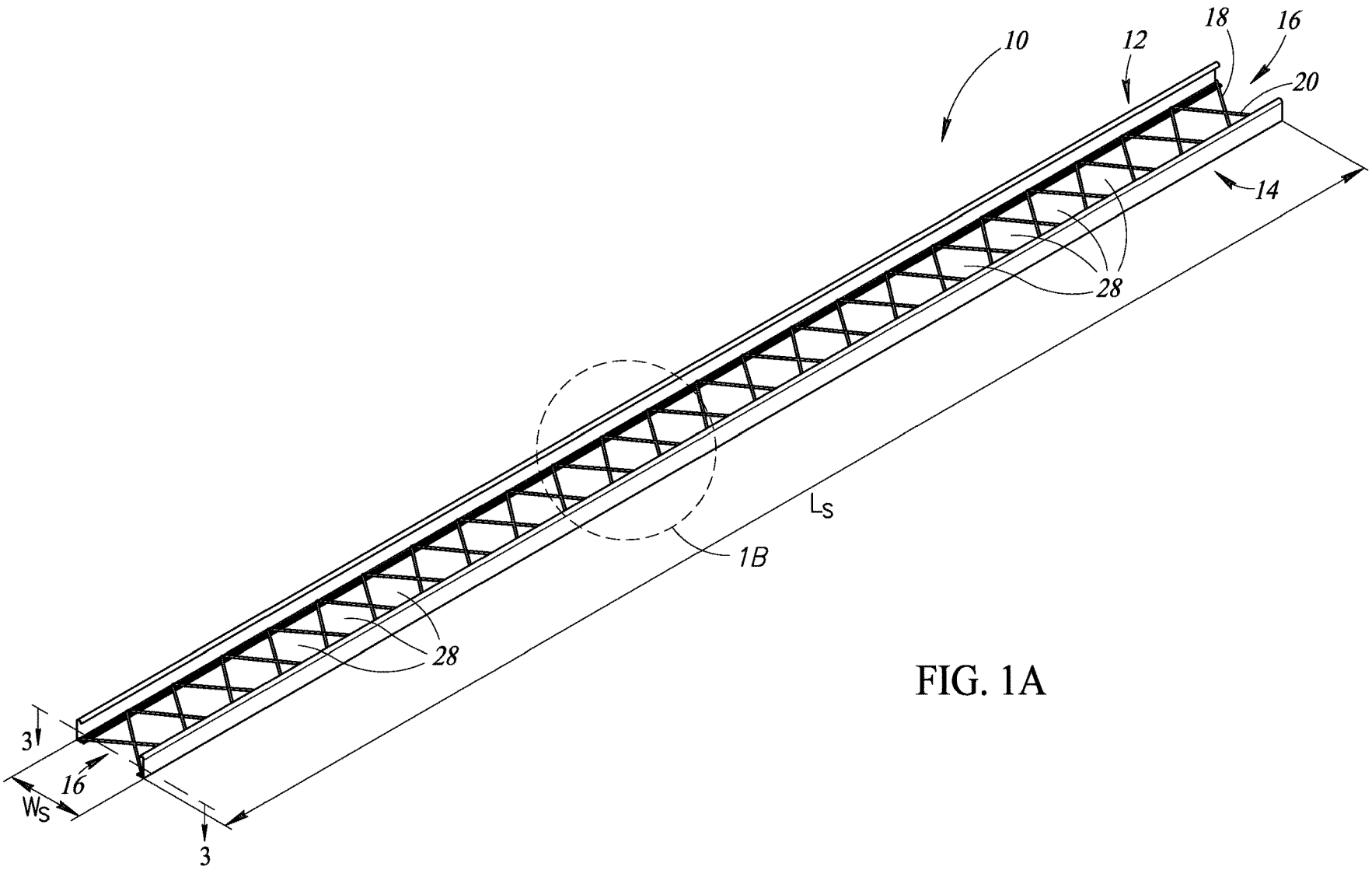
FIG. 1A is an isometric view of a metal stud, according to at least one illustrated embodiment.

FIG. 1A shows a light-weight metal stud 10 according to one aspect of the present disclosure. The stud 10 includes a first elongated channel member 12 and a second elongated channel member 14 positioned at least approximately parallel to and spatially separated from each other. A wire matrix 16 is coupled to and positioned between the first elongated channel member 12 and the second elongated channel member 14 at various portions along the lengths of the members.

Figure 1B:
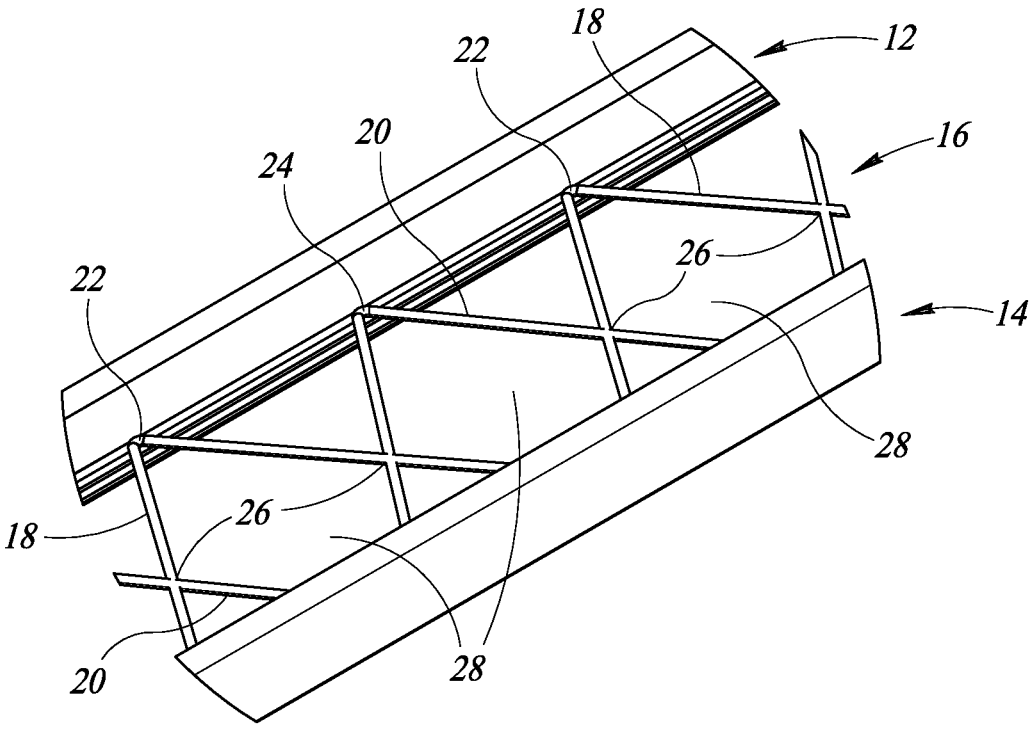
FIG. 1B is an enlarged partial view of the isometric view of a metal stud of FIG. 1A, according to at least one illustrated embodiment.
Figure 2:
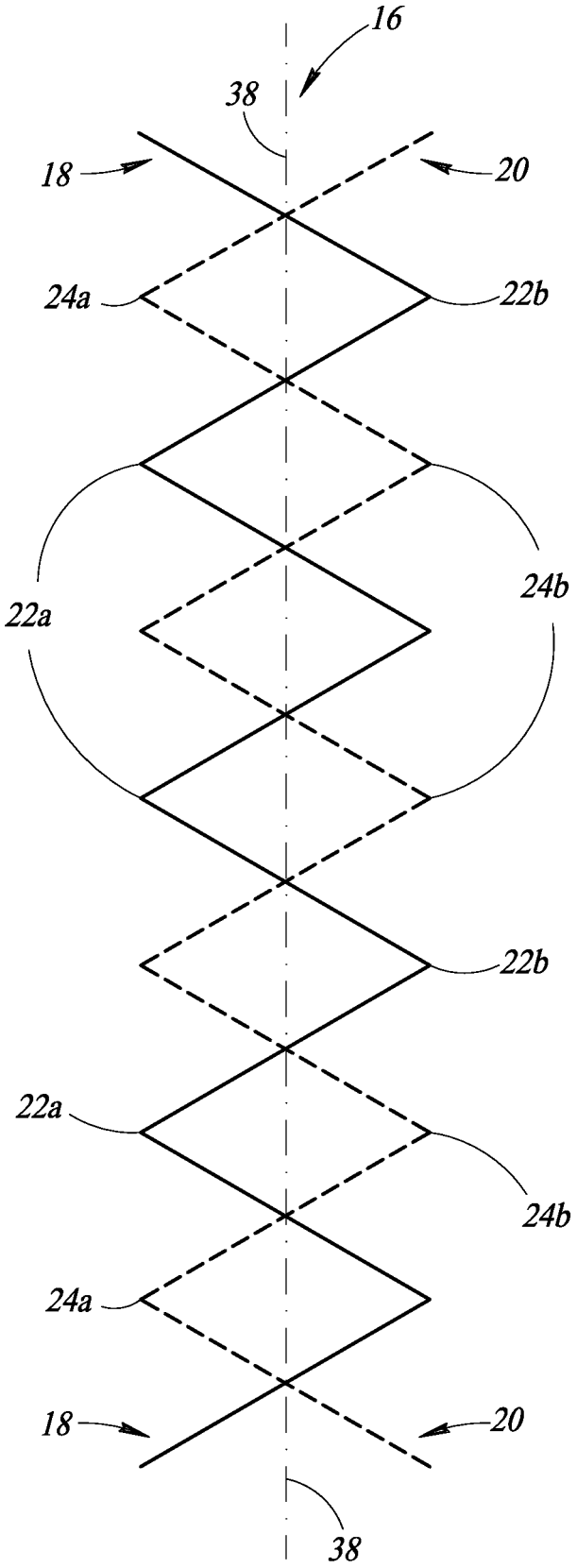
FIG. 2 is a schematic view of a wire matrix of the metal stud of FIG. 1A, according to at least one illustrated embodiment.
Figure 3:
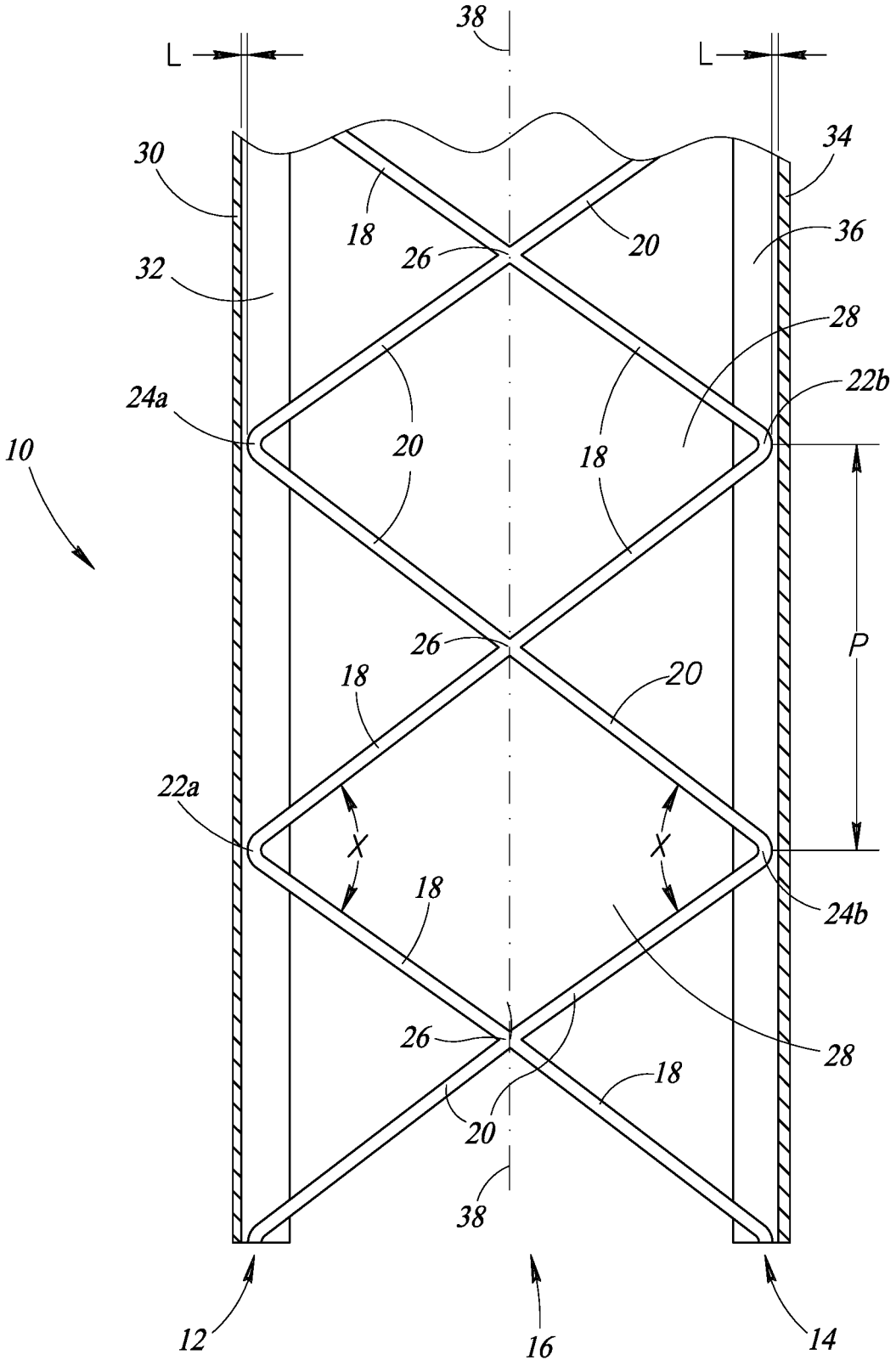
FIG. 3 is a cross-sectional view of a portion of the metal stud of FIG. 1A, taken along line 3-3 in FIG. 1A, according to at least one illustrated embodiment.

As illustrated in FIG. 1B, the wire matrix 16 may be comprised of a first angled continuous wire 18 and a second angled continuous wire 20 coupled to each other (FIG. 2). The first and second angled continuous wires 18, 20 may each be a continuous piece of metal wire. The first angled continuous wire 18 includes a plurality of bends that form a plurality of first apexes 22 that successively and alternately contact the first elongated channel member 12 and the second elongated channel member 14. Likewise, the second angled continuous wire 20 may include a plurality of bends that form a plurality of second apexes 24 to successively and alternately contact the first elongated channel member 12 and the second elongated channel member 14 (FIG. 3). The wire matrix 16 may be formed by overlaying the first angled continuous wire 18 onto the second angled continuous wire 20 and securing the wires to each other, for example with a series of welds or resistance welds, thereby forming a series of intersection points 26 positioned between the first and second elongated channel members 12, 14.

The wire matrix 16 may be secured to the first and second elongated channel members 12, 14 at all first and second apexes 22, 24 such that the first apexes 22 alternate with the second apexes 24 along at least a portion of a length of the first elongated channel member 12 and along at least a portion of a length of the second elongated channel member 14. Accordingly, a series of longitudinal passages 28 are formed along a central length of the wire matrix 16. The longitudinal passages 28 may be quadrilaterals, for instance diamond-shaped longitudinal passages. The longitudinal passages 28 may be sized to receive utilities, for example wiring, wire cables, fiber optic cable, tubing, pipes, other conduit.

The first and second angled continuous wires 18, 20 may each have any of a variety of cross-sectional profiles. Typically, first and second angled continuous wires 18, 20 may each have a round cross-sectional profile. Such may reduce materials and/or manufacturing costs, and may advantageously eliminate sharp edges which might otherwise damage utilities (e.g., electrically insulative sheaths). Alternatively, the first and second angled continuous wires 18, 20 may each have cross-sectional profiles of other shapes, for instance a polygonal (e.g., rectangular, square, hexagonal). Where a polygonal cross-sectional profile is employed, it may be advantageous to have rounded edges or corners between at least some of the polygonal segments. Again, this may eliminate sharp edges which might otherwise damage utilities (e.g., electrically insulative sheaths). Further, the second angled continuous wire 20 may have a different cross-sectional profile from that of the first angled continuous wire 18.

FIG. 2 shows the particular configuration of a wire matrix 16 of the stud 10 shown in FIG. 1A according to one aspect. The wire matrix 16 includes a first angled continuous wire 18 overlying a second angled continuous wire 20, which is shown in dashed lines for purposes of illustration. This illustration shows that each of the first and second angled continuous wires 18, 20 extend between both of the first and second elongated channel members 12, 14 in an overlapping manner such that a length of each first and second angled continuous wires 18, 20 extends from one elongated channel member to the other elongated channel member in an alternating manner (FIG. 3). Accordingly, the first angled continuous wire 18 includes a plurality of apexes 22*a* and 22*b* on either side of the first angled continuous wire 18, and the second angled continuous wire 20 includes a plurality of apexes 24*a* and 24*b* on either side of the second angled continuous wire 20 for attachment to both of the first and second elongated channel members 12, 14.

FIG. 3 shows a portion of a front cross-sectional view of the stud 10 taken along lines 3-3 in FIG. 1A. The first elongated channel member 12 and the second elongated channel member 14 are shown positioned parallel to and spatially separated from each other with the wire matrix 16 coupling the elongated channel members 12, 14 to each other. The first angled continuous wire 18 is formed with a plurality of bends that form a plurality of first apexes 22*a*, 22*b* that successively and alternately contact the first elongated channel member 12 and the second elongated channel member 14. Likewise, the second angled continuous wire 20 is formed with a plurality of bends that form a plurality of second apexes 24*a*, 24*b* to successively and alternately contact the first elongated channel member 12 and the second elongated channel member 14.

Figure 4:
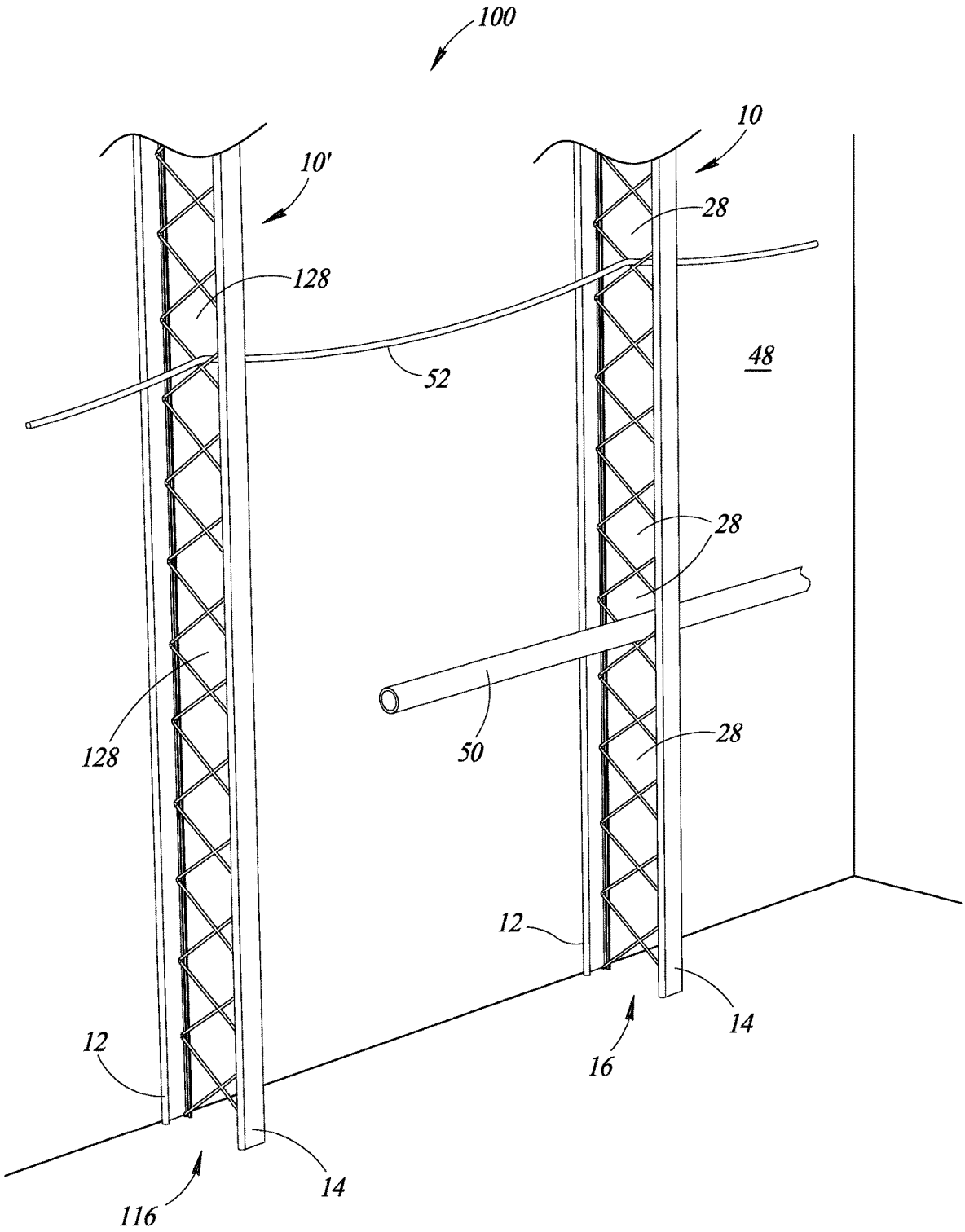
FIG. 4 is an isometric environmental view showing the metal stud of FIG. 1A adjacent a wall, according to at least one illustrated embodiment.

The wire matrix 16 may be formed by overlying the first angled continuous wire 18 onto the second angled continuous wire 20 and securing the wires to each other with a series of welds, such as resistance welds, thereby forming a series of intersection points 26 positioned between the first and second elongated channel members 12, 14. The wire matrix 16 may be secured to the first and second elongated channel members 12, 14, such as by welds such as resistance welds, at all first and second apexes 22*a*, 22*b*, 24*a*, 24*b* such that the first apexes 22*a* alternate with the second apexes 24*a* along a length the first elongated channel member 12, and the first apexes 22*b* alternate with the second apexes 24*b* along a length second elongated channel member 14. Accordingly, a series of longitudinal passages 28 are formed along a longitudinal length of the wire matrix 16. The longitudinal passages 28 have a profile that is substantially separate from the first and second elongated channel members 12, 14. As such, the longitudinal passages 28 may act as a shelf to support and receive utility lines or other devices (FIG. 4).

Where the stud 10 is installed vertically, the first and second angled continuous wires 18, 20 will run at oblique angles to the ground and a gravitational vector (i.e., the direction of a force of gravity), that is, be neither horizontal nor vertical. Thus, the portions of the first and second angled continuous wires 18, 20 which form each of the longitudinal passages 28 are sloped or inclined with respect to the ground. Utilities installed or passing through a longitudinal passage 28 will tend, under the force of gravity, to settle into a lowest point or valley in the longitudinal passage 28. This causes the utility to be at least approximately centered in the stud 10, referred to herein as self-centering. Self-centering advantageously moves the utility away from the portions of the stud to which wallboard or other materials will be fastened. Thus, self-centering helps protect the utilities from damage, for instance damage which might otherwise be caused by the use of fasteners (e.g., screws) used to fasten wallboard or other materials to the stud 10.

The first elongated channel member 12 may have a major face or web 30 and a first flange 32. Likewise, the second elongated channel member 14 may have a major face or web 34 and a first flange 36 (FIG. 3). The wire matrix 16 may be coupled to the flanges 32, 36 periodically along a length of the first and second elongated channel members 12, 14. In some aspects, the first apexes 22*a*, 24*a* may be coupled to the first flange 32 of the first elongated channel member 12 and spatially separated from the major face 30 by a distance L. Likewise, the second apexes 22*b*, 24*b* may be coupled to the first flange 36 of the second elongated channel member 14 and spatially separated from the major face 34 by a distance L.

The distance L in any aspect of the present disclosure can vary from a very small to a relatively large distance. In some configurations, distance L is less than one half of an inch, or less than one quarter of an inch, although distance L can vary beyond such distances. Spatially positioning the apexes from the major faces 30, 34 of the elongated channel members 12, 14 provides one advantage of reducing manufacturing operations and improving consistency of the size and shape of the stud because the elongated channel members can be positioned and secured to the wire matrix relative to each other, as opposed to relative to the shape and size of the wire matrix, which may vary, e.g., due to manufacturing tolerances, between applications.

According to some aspects, the apexes 22 and the apexes 24 laterally correspond to each other as coupled to respective first and second elongated channel members 12, 14. For example, the first apexes 22*a* may be opposed, for instance diametrically opposed, across a longitudinal axis 38 of the stud 10 from the second apexes 24*b* along a length the first elongated channel members 12, 14. For example, apex 22*a* is positioned at a contact portion of the first elongated channel member 12 that corresponds laterally to the position of the apex 24*b* on the second elongated channel member 14. The same holds true for apex 24*a* and apex 22*b*, as best illustrated in FIG. 3. The plurality of first and second apexes 22, 24 extend along the length of the stud 10 and are coupled successively and alternately to the first and second elongated channel members 12, 14. As illustrated in FIGS. 2 and 3, the first and second angled continuous wires 18 and 20 can be mirror images of one another across a central longitudinal axis 38 that extends along the length of the stud 10 and through the center of the stud 10 in a direction parallel to the lengths of the first and second elongated channel members 12 and 14, such that the wire matrix 16 is symmetrical about the axis 38. In other embodiments, the wire matrix 16 is not symmetrical about the axis 38.

The first angled continuous wire 18 has an apex 22*b* coupled to the second elongated channel member 14, while the second angled continuous wire 20 has an apex 24*b* coupled to the second elongated channel member 14 adjacent apex 22*b* and spaced apart from apex 22*b* by a distance or pitch P. Pitch P can be a given distance less than ten inches, or less than eight inches, although the given distance can vary beyond such distances. The first and second angled continuous wires 18, 20 may be bent at an angle X, as shown near the apex 22*a* and apex 24*b*. Angle X can be between approximately 60 and 120 degrees, or approximately 90 degrees, or between approximately 30 and 60 degrees, or approximately 45 degrees, although angle X could vary beyond such values and ranges. Angle X has a corresponding relationship to pitch P. Thus, the continuous wires 18, 20 could be formed at a relatively small angle X (less than 30 degrees), which reduces the distance of pitch P, which can increase strength of the stud 10 for particular applications.

FIG. 4 shows a stud system 100 having a pair of lightweight metal studs according to one aspect of the present disclosure. The system 100 includes a first stud 10 and a second stud 10' positioned spatially apart from each other and against a wall 48, as with typical structural arrangements. The first stud 10 and the second stud 10' each include a first elongated channel member 12 and a second elongated channel member 14 positioned parallel to and spatially separated from each other. The first stud 10 includes a wire matrix 16 coupled to and positioned between the first elongated channel member 12 and the second elongated channel member 14 at various portions along the lengths of the members, such as described with reference to FIGS. 1-3. The second stud 10' includes a wire matrix 116 coupled to and positioned between the first elongated channel member 12 and the second elongated channel member 14 at various portions along the length of the elongated channel members, such as described with reference to FIGS. 1-3.

The wire matrices 16 and 116 of the studs 10 and 10', respectively, each define a plurality of longitudinal passages 28 and 128, respectively, along a central length of the wire matrices 16 and 116. The longitudinal passages 28 and 128 may partially or completely structurally support utility lines, such as an electrical wire 52 and a pipe 50. Additionally, the longitudinal passages 28 and 128 allow egress of utility lines to physically separate the utility lines from each other and away from sharp edges of the first and second elongated channel members 12, 14 to reduce or prevent damage to the lines and to increase safety.

As illustrated in FIGS. 1A, 3, and 4, the studs 10 and 10' and the elongated channel members 12 and 14 can have respective first ends, such as along the axis 38, and respective second ends, such as opposed to the first ends along the axis 38. The first and second angled continuous wires 18 and 20 have respective first ends welded to the first ends of the studs 10 and 10' and the first ends of the elongated channel members 12 and 14, and respective second ends welded to the second ends of the studs 10 and 10' and the second ends of the elongated channel members 12 and 14. In some cases, the first and second ends of the first and second angled continuous wires 18 and 20 can coincide with apexes (e.g., apexes 22*a* and 24*b* or apexes 22*b* and 24*a*) of the first and second angled continuous wires 18 and 20 to within the range of 0.010 inches.

Figure 5A:
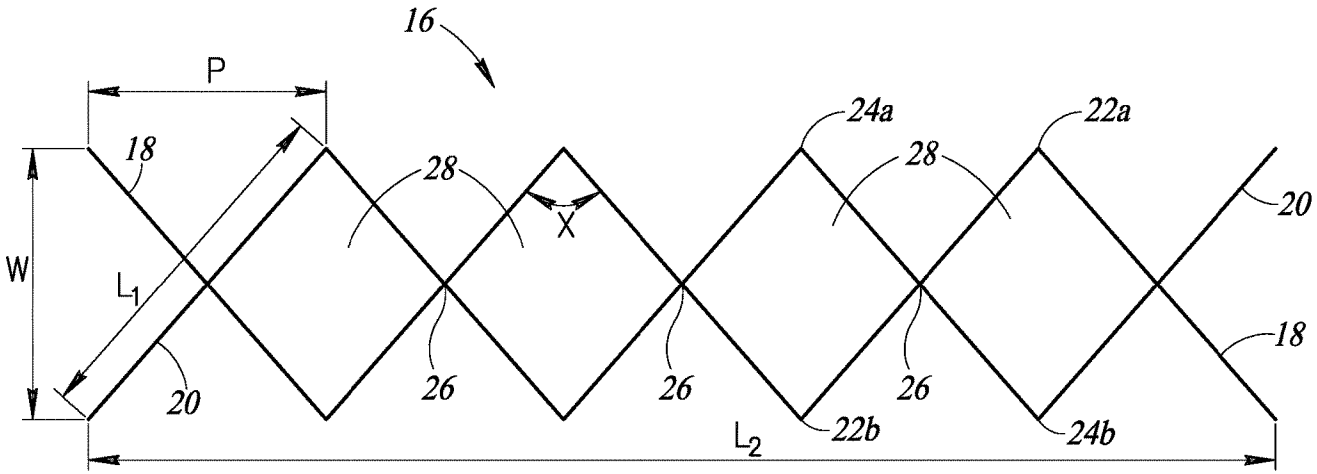
FIG. 5A is a schematic view of a wire matrix of the metal stud of FIG. 1A in an un-tensioned or an un-stretched configuration, according to at least one illustrated embodiment.
Figure 5B:
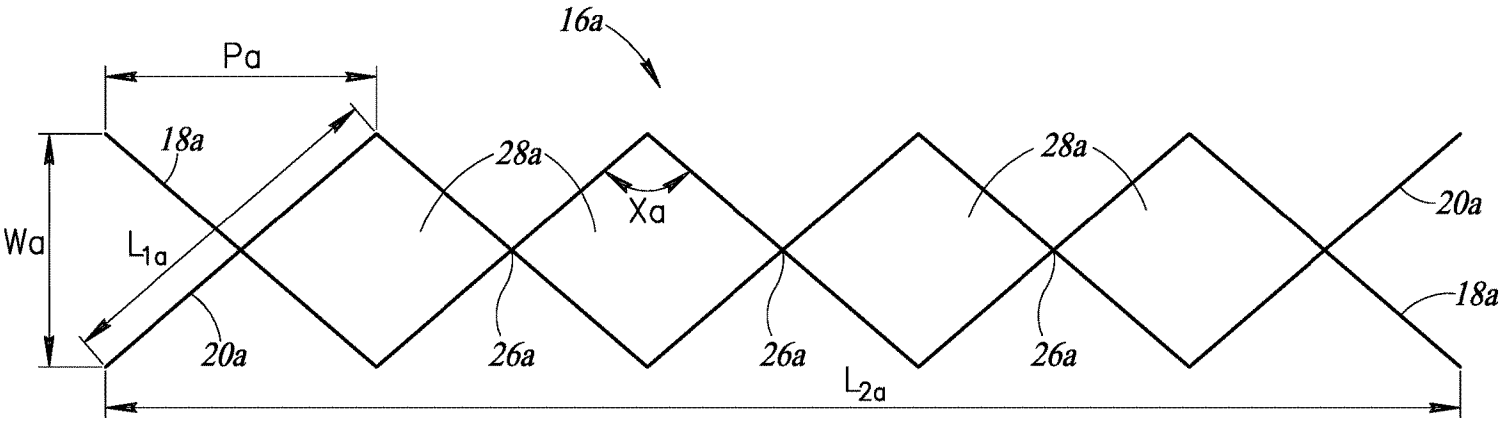
FIG. 5B is a schematic view of the wire matrix of FIG. 5A in a tensioned or a stretched configuration, according to at least one illustrated embodiment.

In some methods of manufacturing a metal stud such as the stud 10, a wire matrix such as the wire matrix 16 can be fabricated as described above, and can then be tensioned or stretched along its length, which can involve elastically, plastically, or a combination of elastically and plastically stretching the wire matrix, and which can involve temporarily or permanently increasing the length of the wire matrix, as described further below, before being coupled to first and second elongated channel members such as channel members 12 and 14. For example, FIG. 5A is a schematic view of the wire matrix 16 in an un-tensioned or an un-stretched configuration, illustrating the first angled continuous wire 18 and the second angled continuous wire 20, as well as their intersection points 26 and the longitudinal passages 28 they form. FIG. 5B is a schematic view of the wire matrix 16 in a modified, tensioned, or stretched configuration, indicated by reference numeral 16*a*, including the first angled continuous wire 18 in a modified, tensioned, or stretched configuration, indicated by reference numeral 18*a*, and the second angled continuous wire 20 in a modified, tensioned, or stretched configuration, indicated by reference numeral 20*a*, as well as their intersection points 26*a* and the longitudinal passages 28*a* they form.

Figure 5C:
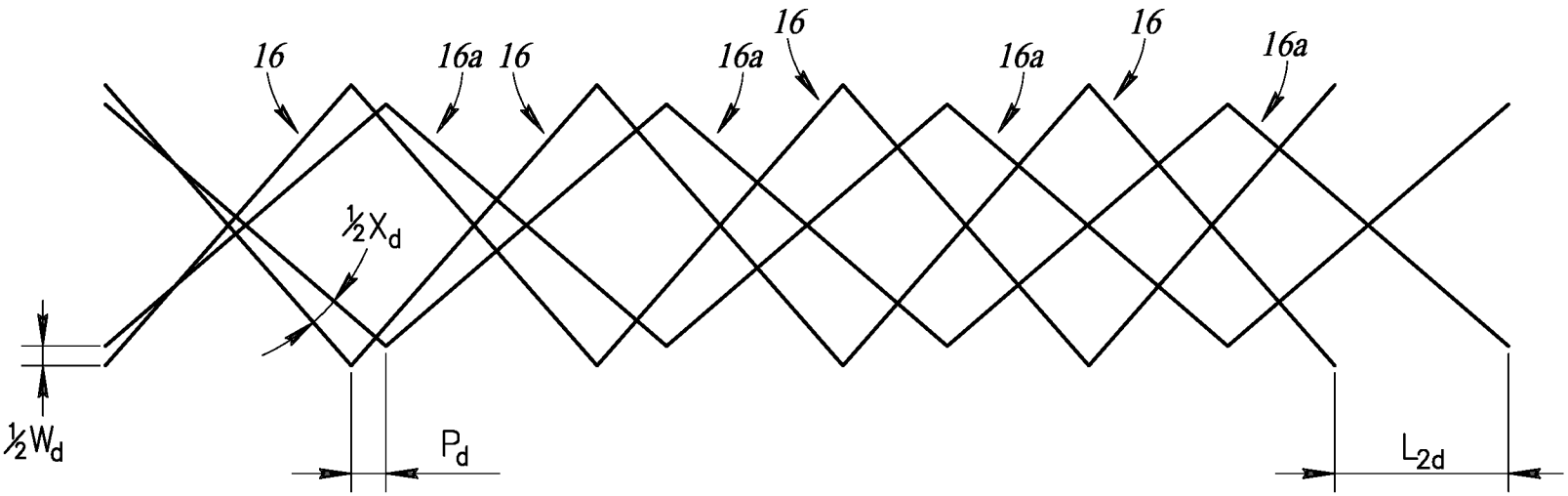
FIG. 5C is a schematic view of the wire matrix as illustrated in FIG. 5A overlaid with the wire matrix as illustrated in FIG. 5B, according to at least one illustrated embodiment.

FIG. 5C is a schematic view of the un-stretched wire matrix 16, as illustrated in FIG. 5A, overlaid with the stretched wire matrix 16*a*, as illustrated in FIG. 5B. As shown in FIGS. 5A-5C, a stretching operation performed on the wire matrix 16 can change several dimensions and features of the wire matrix 16, while leaving other dimensions and features unchanged. As an example, FIGS. 5A and 5B illustrate that the first angled continuous wire 18 includes a plurality of linear sections extending between and interconnecting its apexes 22*a* and 22*b*, and that the second angled continuous wire 20 includes a plurality of linear sections extending between and interconnecting its apexes 24*a* and 24*b*. As illustrated in FIGS. 5A and 5B, each of these linear sections has a length of $L_1$ in the un-stretched wire matrix 16, and a length of $L_{1a}$ in the stretched wire matrix 16*a*. $L_1$ is the same as or equal to $L_{1a}$, reflecting the fact that the stretching operation does not change the lengths of these individual linear sections.

As another example, as also illustrated in FIGS. 5A-5C, the first and second angled continuous wires 18 and 20 may be bent at an angle X in the un-stretched configuration, while the first and second angled continuous wires 18*a* and 20*a* may be bent at an angle $X_a$ in the stretched configuration, where the angle $X_a$ is greater than the angle X by an angle difference $X_d$ (note one half of angle $X_d$ is illustrated in FIG. 5C). As another example, as also illustrated in FIGS. 5A-5C, adjacent apexes of the first and second angled continuous wires 18 and 20, e.g., adjacent apexes 22*a* and 24*a*, or adjacent apexes 22*b* and 24*b*, are spaced apart from one another by a distance or pitch P in the un-stretched configuration, while adjacent apexes of the first and second angled continuous wires 18*a* and 20*a* are spaced apart from one another by a distance or pitch $P_a$ in the stretched configuration, where the pitch P is less than the pitch $P_a$ by a pitch difference $P_d$.

As another example, as also illustrated in FIGS. 5A-5C, the wire matrix 16 has an overall length $L_2$ in the un-stretched configuration, while the wire matrix 16*a* has an overall length $L_{2a}$ in the stretched configuration, where the length $L_2$ is less than the length $L_{2a}$ by a length difference $L_{2d}$. As another example, as also illustrated in FIGS. 5A-5C, the wire matrix 16 has an overall width Win the un-stretched configuration, while the wire matrix 16*a* has an overall width $W_a$ in the stretched configuration, where the width W is greater than the width $W_a$ by a width difference $W_d$ (note one half of width difference $W_d$ is illustrated in FIG. 5C).

These features and dimensions are geometrically interrelated with one another. For example, as the wire matrix 16 is longitudinally stretched, the pitch P and the overall length $L_2$ increase linearly with one another (i.e., a ratio of $P_d$ to $L_{2d}$ remains constant throughout a stretching operation) in accordance with the degree of stretching. Further, as the wire matrix 16 is longitudinally stretched, and therefore as the pitch P and the length $L_2$ increase, the angle X increases and the width W decreases in accordance with the degree of stretching and the geometric relationships of the various components. Thus, longitudinal stretching of the wire matrix 16 increases the distance L (see FIG. 3) for a given spacing between the first and second elongated channel members 12 and 14. As noted above, the length $L_1$ remains constant or unchanged over the course of a stretching operation as the wire matrix 16 is stretched.

Figure 6:
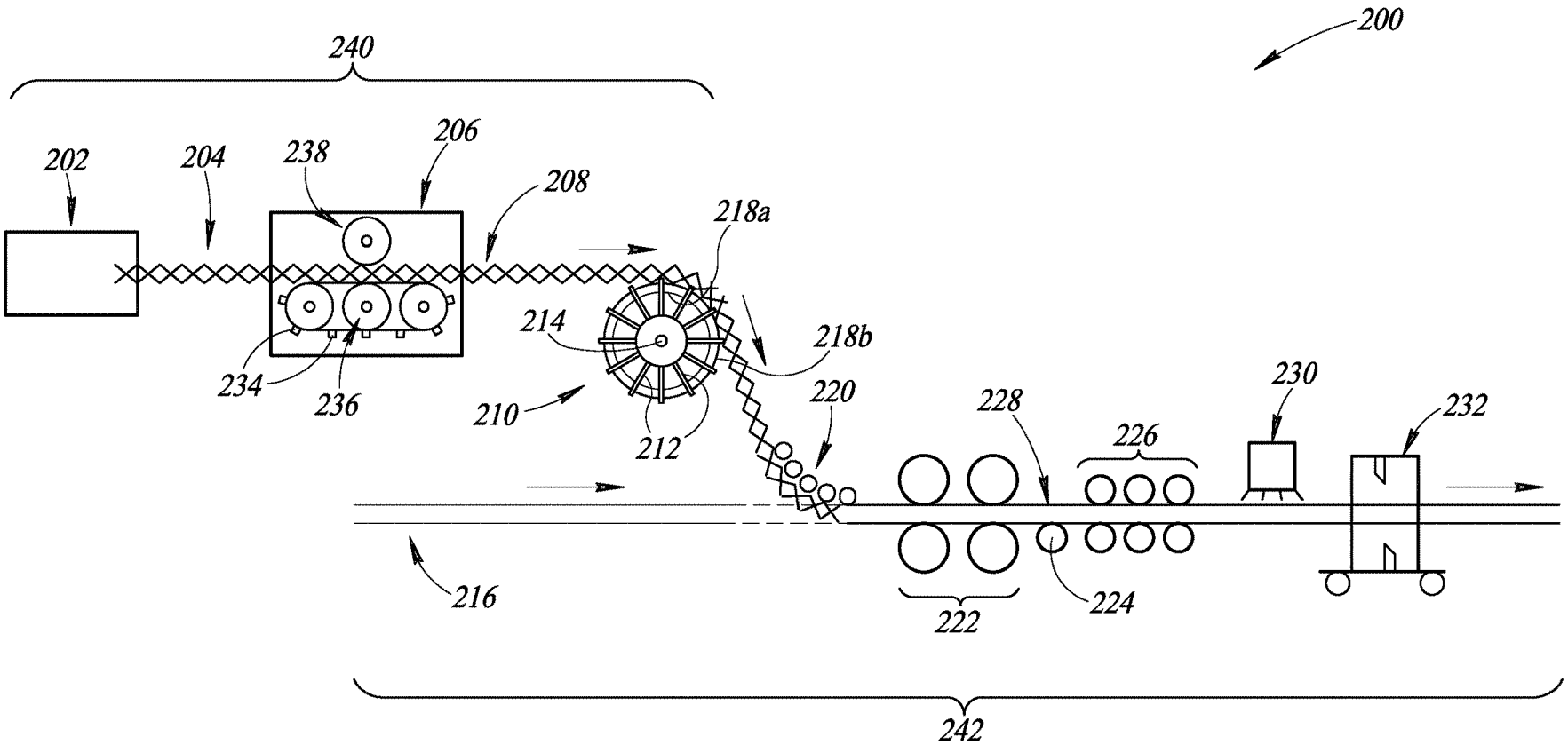
FIG. 6 is a schematic view of an assembly line for fabricating a plurality of varied-length metal studs, according to at least one illustrated embodiment.
Figure 10:
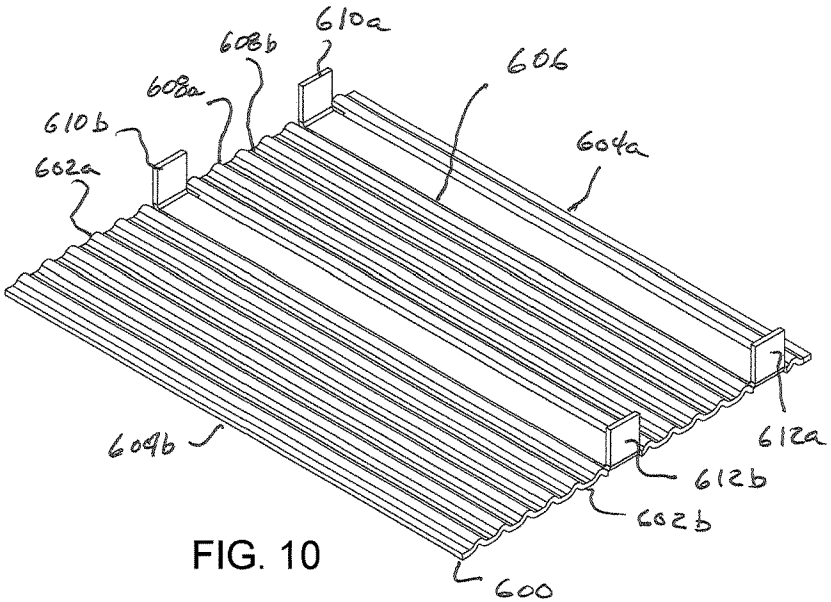
FIG. 10 is an isometric view of the reinforcement plate of FIG. 7 in the folded configuration.
Figure 9:
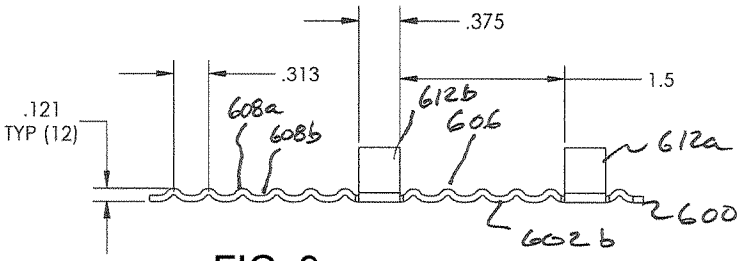
FIG. 9 is a right side elevational view of the reinforcement plate of FIG. 7 in the folded configuration.
Figure 7:
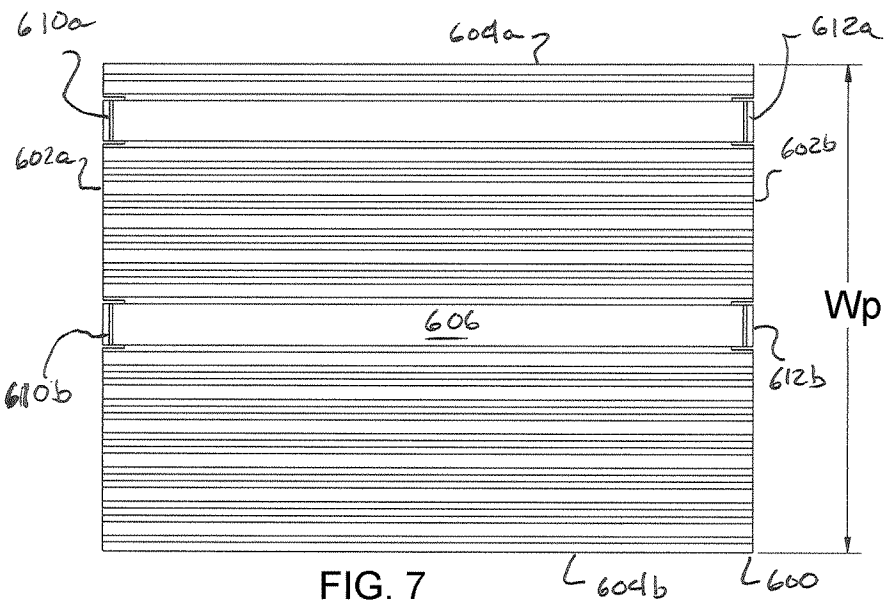
FIG. 7 is a top plan view of a reinforcement plate in a folded configuration, according to at least one illustrated embodiment.
Figure 8:
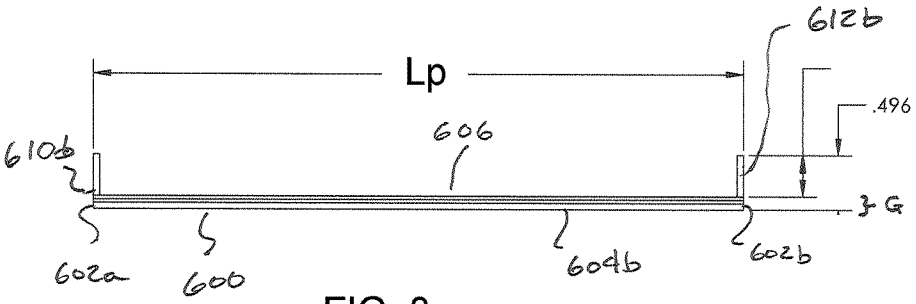
FIG. 8 is a front elevational view of the reinforcement plate of FIG. 7 in the folded configuration.

FIG. 6 is a schematic view of an assembly line 200 for fabricating a plurality of varied-length metal studs or an individual stud having any specified width and any specified length, including any standard or non-standard width and length. For example, the assembly line 200 can be used to fabricate a plurality of metal studs having respective lengths that differ from one another by increments that are less than a pitch of the wire matrix of the studs, such as by 4 inches or less, 3 inches or less, 2 inches or less, 1 inch or less, ½ inch or less, ¼ inch or less, ⅛ inch or less, 1/16 inch or less, or by any desired increment.

As illustrated in FIG. 6, the assembly line 200 can include one or more, e.g., one or two, zig-zag wire benders or formers 202. The zig-zag wire benders 202 can take standard, off-the-shelf linear wire as input and output two zig-zag wires 204, from which a plurality of angled continuous wires, such as the first and second angled continuous wires 18 and 20, can eventually be singulated and formed. Thus, the zig-zag wires 204 can have structures matching the structures of the first and second angled continuous wires 18 and 20, as described above, but in a continuous form.

The assembly line 200 can also include a first welding system 206, which can include a plurality of spring-loaded pins 234 carried by a moving conveyor 236, and a rotary resistance welding system 238. The first welding system 206 can accept the two zig-zag wires 204 as input and synchronize the movement of the two zig-zag wires 204 by engaging the pins 234 with apexes of the zig-zag wires 204 and pulling the zig-zag wires 204 taut so that the apexes of the zig-zag wires 204 are spaced apart from one another by a nominal pitch (e.g., as discussed further below). The first welding system 206 can also weld (e.g., resistance weld) the two zig-zag wires 204 to one another at their intersection points, such as by using the rotary resistance welding system 238, thereby forming a continuous wire matrix 208. The zig-zag wires 204 and the continuous wire matrix 208 are illustrated in FIG. 6 as being oriented vertically and within the page for purposes of illustration, although in practice, the zig-zag wires 204 and the continuous wire matrix 208 are oriented horizontally and into the page.

The continuous wire matrix 208 can be a continuous wire matrix from which a plurality of individual wire matrices such as the wire matrix 16 can eventually be singulated and formed. Thus, the continuous wire matrix 208 can have a structure matching the structure of the wire matrix 16, but in a continuous form. For example, the continuous wire matrix 208 can have a nominal, or un-stretched pitch corresponding to the pitch P illustrated in FIG. 5A, and a nominal, or un-stretched width corresponding to the width W illustrated in FIG. 5A. It has been found that using a continuous wire matrix 208 having a consistent nominal pitch of about 6 inches to fabricate metal studs having a variety of specified overall lengths and widths, and using a continuous wire matrix 208 having a nominal width that varies based on the specified overall widths of the metal studs to be fabricated, is advantageous.

The assembly line 200 can also include an expanding mandrel pitch spacing mechanism, which can be referred to as a first, upstream conveyor 210. The first, upstream conveyor 210 can include a plurality of radially extending pins 212, a first encoder 214, and a plurality of expanding mandrel segments 218 that can ride radially inward and outward along the pins 212 between an inner position, designated by reference numeral 218*a* and in which the expanding mandrel segments 218 have a length of 6 inches, and an outer position, designated by reference numeral 218*b* and in which the expanding mandrel segments 218 have a length of 6⅜ inches. The radial positions of the expanding mandrel segments 218 can be adjusted along the pins 212 to alter the lengths of the expanding mandrel segments 218 between the respective pins 212, so that the lengths of the expanding mandrel segments 218 match the nominal pitch of the continuous wire matrix 208, and so that the continuous wire matrix 208 can be positioned against the expanding mandrel segments 218 as the continuous wire matrix passes over the first, upstream conveyor 210.

As the continuous wire matrix 208 passes over the first conveyor 210, the pins 212 can engage with the continuous wire matrix 208, such as by extending through the longitudinal passages extending through the continuous wire matrix 208 and thereby engaging with the welded intersections of the continuous wire matrix 208 or with the apexes of the zig-zag wires 204, to meter the rate at which the continuous wire matrix 208 exits the first conveyor 210 and to prevent the continuous wire matrix 208 from exiting the first conveyor 210 more quickly than desired. In some cases, this can include applying a force to the continuous wire matrix 208, e.g., to the welded intersections of the continuous wire matrix 208 or to the apexes of the zig-zag wires 204, in a direction opposite to the direction the continuous wire matrix 208 travels through the first conveyor 210 and through the assembly line 200. In other implementations, the first conveyor 210 can engage with the continuous wire matrix 208 by other techniques, such as those described below for the second conveyor 226.

The zig-zag wire benders 202, the first welding system 206, and the first conveyor 210 can be arranged on a first processing line 240 which can be on an elevated mezzanine level on a factory floor. Continuous elongated channel members 216 can be formed by a sheet metal roll former located below the elevated mezzanine level on the factory floor, and can be introduced and metered into the assembly line 200 along a second processing line 242, located below the elevated mezzanine level on the factory floor, that runs in parallel to and below the first processing line 240. In alternative implementations, the second processing line 242 can run above or at the same elevation as and to the side of the first processing line 240, rather than below the first processing line 240. A plurality of individual elongated channel members such as the first and second elongated channel members 12 and 14 can eventually be singulated and formed from the continuous elongated channel members 216. Thus, the continuous elongated channel members 216 can have a structure matching the structure of the first and second elongated channel members 12 and 14, but in a continuous form.

The assembly line 200 can also include a plurality of rollers 220 arranged to extend from a last one of the rollers 220 nearest to a second welding system 222, which can be a resistance welding system, and which is described further below, and in the second processing line 242, away from the second welding system 222 and toward the first processing line 240, that is, to extend upstream with respect the assembly line 200 and upward away from the continuous elongated channel members 216. Together, the first conveyor 210 and the plurality of rollers 220 form an S-shaped conveyor that precisely guides the continuous wire matrix 208 along a constant-length path and with minimal friction to reduce changes to the degree to which the continuous wire matrix 208 is tensioned or stretched, from the first processing line 240 to the second processing line 242.

The continuous wire matrix 208 travels over the first conveyor 210 and under the plurality of rollers 220 from the first conveyor 210 to the second welding system 222, from the first processing line 240 into the second processing line 242, and into physical proximity or engagement with the continuous elongated channel members 216. The assembly line 200 then carries the continuous wire matrix 208 and the continuous elongated channel members 216 into the second welding system 222, which can include a dual-station rotary welding system having powered and spring-loaded wheels to create a welding pressure to weld (e.g., resistance weld) apexes of the continuous wire matrix 208 to flanges of the continuous elongated channel members 216. The second welding system 222 can weld (e.g., resistance weld) the continuous wire matrix 208 to the continuous elongated channel members 216, to form a continuous elongate metal stud 228.

In doing so, the wheels of the second welding system 222 can engage with the continuous elongated channel members 216 to weld the continuous wire matrix 208 thereto, without contacting the continuous elongate channel members 216 in locations where the continuous wire matrix 208 is not to be welded thereto. Thus, contact between the wheels of the second welding system 222 and the continuous elongated channel members 216 and the continuous wire matrix 208 is intermittent. A plurality of elongate metal studs, such as metal stud 10, can eventually be singulated and formed from the continuous elongate metal stud 228. Thus, the continuous elongate metal stud 228 can have a structure matching the structure of the metal stud 10, as described above, but in a continuous form.

The assembly line 200 also includes a second encoder 224 and a second, downstream conveyor 226, which can include a plurality of pull rolls that engage the continuous elongate metal stud 228, e.g., engage flanges of the continuous elongated channel members 216 of the continuous elongate metal stud 228 frictionally or otherwise mechanically, or by other techniques, such as those described above for the first conveyor 210, and meter the rate at which the continuous elongate metal stud 228 exits the second conveyor 226, and to prevent the continuous elongate metal stud 228 from exiting the second conveyor 226 more slowly than desired. In some cases, this can include applying a force to the continuous elongate metal stud 228 in a direction aligned with the direction the continuous elongate metal stud 228 travels through the second conveyor 226 and through the assembly line 200.

Thus, the first conveyor 210 can act to hold the continuous wire matrix 208 back as it travels through the assembly line 200 (e.g., it can apply a force to the continuous wire matrix 208 that acts in a direction opposite to its direction of travel, i.e., in an upstream direction), while the second conveyor 226 can act to pull the continuous elongate metal stud 228, and thus the wire matrix 208, forward as they travel through the assembly line 200 (e.g., it can apply a force to the continuous elongate metal stud 228 that acts in a direction aligned with its direction of travel, i.e., in an downstream direction). Thus, together, the first conveyor 210 and the second conveyor 226 can apply tension to the continuous wire matrix 208 such that the continuous wire matrix 208 is stretched, either elastically or plastically, between the first conveyor 210 and the second conveyor 226, and held in a tensioned or stretched configuration as it is welded (e.g., resistance welded) to the continuous elongated channel members 216. This can be referred to as "pre-tensioning" the continuous wire matrix 208.

As a result of the stretching, the continuous wire matrix 208 can travel through the first processing line 240 at a first speed, which can be constant throughout the first processing line 240, and through the second processing line 242 at a second speed, which can be constant throughout the second processing line 242. In some cases, such as when the continuous wire matrix 208 is to be stretched, the second speed is greater than the first speed. In other cases, such as when the continuous wire matrix 208 is not to be stretched, the second speed is the same as the first speed. The first and the second speeds can be between 200 and 300 feet per minute.

Further, by controlling a rate at which the first conveyor 210 meters the continuous wire matrix 208, and by controlling a rate at which the second conveyor 226 meters the continuous elongate metal stud 228, the tension developed in the continuous wire matrix 208, and a degree to which the continuous wire matrix 208 is stretched, can be precisely controlled. For example, after being stretched, the continuous wire matrix 208 can have a stretched pitch corresponding to the pitch $P_a$ illustrated in FIG. 5B, which is typically greater than the nominal pitch of about 6 inches by the pitch difference $P_d$ illustrated in FIG. 5C, and a stretched width corresponding to the width $W_a$ illustrated in FIG. 5B, which is typically greater than the nominal width by the width difference $W_d$ illustrated in FIG. 5C. In some implementations, the pitch difference $P_d$ can be anywhere from 0 inches up to at least ⅜ inch.

During operation of the assembly line 200, the first encoder 214 can measure a length of the continuous wire matrix 208 metered out by the first conveyor 210, such as by counting a number of the welded intersections of the wires of the wire matrix 208 that pass over the first conveyor 210. During operation of the assembly line 200, the second encoder 224 can measure a length of the continuous wire matrix 208 metered into the second conveyor 226, such as by measuring a length of the continuous elongate metal stud 228 entering into the second conveyor 226. In some cases, the encoders 214 and 224 can be reset every time a length material corresponding to an individual metal stud is measured by the encoder 214 or 224, respectively, to reduce or eliminate the accumulation of measurement errors across a large number of studs.

An output of the first encoder 214 can be compared to an output of the second encoder 224 to check that the continuous wire matrix 208 is being stretched to a specified degree. If the comparison of these outputs reveals that the continuous wire matrix 208 is being stretched to the specified degree, then no corrective action can be taken. If the comparison of these outputs reveals that the continuous wire matrix 208 is being stretched to more than the specified degree, then corrective action can be taken to speed up the first processing line 240 or slow down the second processing line 242. If the comparison of these outputs reveals that the continuous wire matrix 208 is being stretched to less than the specified degree, then corrective action can be taken to slow down the first processing line 240 or speed up the second processing line 242.

The assembly line 200 can also include a laser scanning system 230, which can scan the continuous elongate metal stud 228 as it exits the second conveyor 226. For example, the laser scanner 230 can scan the continuous elongate metal stud 228 and measure the distance between adjacent welded intersections of the wires of the wire matrix 208. Such distances can be averaged over a length of the continuous elongate metal stud 228 that corresponds to a length of an individual stud to be singulated from the continuous elongate metal stud 228, which average can then be compared to a desired average pitch for the individual stud.

If this comparison reveals that the continuous wire matrix 208 is being stretched to the specified degree, then no corrective action can be taken. If this comparison reveals that the continuous wire matrix 208 is being stretched to more than the specified degree, then corrective action can be taken to speed up the first processing line 240 or slow down the second processing line 242. If this comparison reveals that the continuous wire matrix 208 is being stretched to less than the specified degree, then corrective action can be taken to slow down the first processing line 240 or speed up the second processing line 242.

The assembly line 200 can also include a flying shear cutting system 232, which can shear or cut the continuous elongate metal stud 228 in order to singulate and form a plurality of individual metal studs, such as metal stud 10, from the continuous elongate metal stud 228. Actuation of the flying shear cutting system 232 to cut the continuous elongate metal stud 228 can be triggered by a signal provided by the laser scanner 230 that signifies that a desired or specified number of welded intersections of the wires of the wire matrix 208 have passed by the laser scanner 230.

Upon receipt of such a signal from the laser scanner 230, the flying shear cutting system 232 can accelerate a cutting unit thereof from a home position in the direction of travel of the continuous elongate metal stud 228 until a speed of the cutting unit matches the speed of the continuous elongate metal stud 228, at which point, the cutting unit can be actuated to cut the continuous elongate metal stud 228. The cutting unit can then be decelerated to a stop and then returned to its home position. A position of the laser scanner 230 can be adjusted and calibrated experimentally during commissioning of the assembly line 200 until the cutting unit cuts the continuous elongate metal stud 228 at apexes of the wire matrix 208 to within an accuracy of 0.010 inches. Using the features described herein, errors affecting this accuracy are not cumulative and thus the accuracy can remain constant throughout production. In some cases, such adjusting and calibrating can be performed with a continuous elongate metal stud 228 having a wire matrix 208 with a pitch of 6 inches, and the laser scanner 230 can be mounted on a servo-driven positioner so that the laser scanner 230 can be moved and adjusted as needed during operation of the assembly line 200 to ensure that the cutting unit cuts individual metal studs having wire matrices of different pitches at apexes of the wire matrices.

A method of using the assembly line 200 to fabricate a metal stud, such as the metal stud 10, to have a specified overall width $W_s$, e.g., in a direction from the first major face 30 to the second major face 34, and a specified overall length $L_s$, e.g., in a direction along the axis 38 in FIG. 3, can include first selecting a specified overall width $W_s$ for the metal stud 10 and a specified overall length $L_s$ for the metal stud 10. For example, the specified overall width $W_s$ can be about 8 inches, about 6 inches, or about 3⅝ inches, and the specified overall length $L_s$ can be about 8 feet, about 10 feet, or about 12 feet. The method can also include selecting a nominal pitch for the continuous wire matrix 208, which can be about 6 inches, and the distance L, as shown in FIG. 3.

Once these dimensions have been selected or otherwise identified, a degree of stretching for the continuous wire matrix 208 can be determined. For example, it has been found to be advantageous to manufacture the metal stud 10 so that when the metal stud 10 is fabricated and singulated, such as by the flying shear cutting system 232, apexes (e.g., apexes 22*a*, 22*b*, 24*a*, and/or 24*b*) of the first and second angled continuous wires 18 and 22 are located at both ends of the metal stud 10 along its length and welded to respective ends of the first and second elongated channel members 12 and 14 along their lengths, as illustrated in FIGS. 1A, 3, and 4.

Thus, the degree of stretching can be determined so that, after the continuous wire matrix 208 has been stretched, a first pair of apexes of the zig-zag wires 204 (e.g., where the first pair of apexes are diametrically opposed to one another across a width of the zig-zag wires 204) is spaced apart from a second pair of apexes of the zig-zag wires 204 (e.g., where the second pair of apexes are diametrically opposed to one another across a width of the zig-zag wires 204) by the selected specified overall length $L_s$ for the metal stud 10. Thus, when the continuous elongate metal stud 228 is singulated by the flying shear cutting system 232, the first pair of apexes is located at a first end of the singulated metal stud 10, the second pair of apexes is located at a second end of the singulated metal stud 10 opposite to its first end, the first pair of apexes is welded to respective first ends of the singulated channel members 12 and 14, and the second pair of apexes is welded to respective second ends of the singulated channel members 12 and 14 opposite to their first ends.

The method can then include determining a nominal width for the continuous wire matrix 208, which can be configured to facilitate the assembly of the metal stud 10 to have the selected specified overall width $W_s$. For example, the nominal width can be equal to the specified overall width $W_s$, minus the combined thicknesses of the first and second major faces 30 and 34, minus two times the selected distance L, plus an expected width difference, corresponding to the width difference $W_d$, resulting from the stretching of the continuous wire matrix 208 by the determined degree of stretching.

The zig-zag wire benders 202 can then form the zig-zag wires 204 such that once they are welded to one another by the first welding system 206 to form the continuous wire matrix 208, and before the continuous wire matrix 208 is stretched, the continuous wire matrix 208 has the selected nominal pitch and the determined nominal width. The first welding system 206 can then weld the zig-zag wires 204 to one another to form the continuous wire matrix 208. The first and second conveyors 210, 226, can then pull on the continuous wire matrix 208 in opposite directions to stretch the continuous wire matrix 208 by the determined degree of stretching, either elastically or plastically, and to pull the continuous wire matrix 208 through the assembly line 200. The first conveyor 210 and the plurality of rollers 220 can then carry the stretched continuous wire matrix 208 from the first processing line 240 to the second processing line 242 and into physical proximity and/or engagement with the continuous elongated channel members 216.

The second welding system 222 can then weld the continuous wire matrix 208 to the continuous elongated channel members 216, and the flying shear cutting system 232 can cut the continuous elongate metal stud 228, such as by cutting the continuous elongate metal stud 228 at locations where the apexes (e.g., the first and second pairs of the apexes) of the continuous wire matrix 208 are welded to the flanges of the continuous elongated channel members 216, into individual or singulated metal studs such as metal stud 10. Such singulated metal studs can have wire matrices that remains in tension after singulation and even after installation at a work site. Thus, the methods described herein can result in metal studs having wire matrices that carry residual stresses after fabrication.

By fabricating the continuous wire matrix 208 to have a nominal pitch of about 6 inches, and stretching the continuous wire matrix 208 to have a stretched pitch that is greater than the nominal pitch by a pitch difference of between 0 inches and at least ⅜ inch, the assembly line 200 and the features described herein can be used to fabricate the metal stud 10 to have apexes of its first and second angled continuous wires 18 and 20 welded to both ends of the first and second elongated channel members 12 and 14 while having any specified overall length $L_s$ above 8 feet.

It has been found that the features described herein can be used to fabricate a metal stud having a variation in the pitch of its wire matrix along its length of within the range of ±0.062 inches, or in some cases within the range of ±0.010 inches, and having ends of the first and second angled continuous wires 18 and 20 coincide with apexes (e.g., apexes 22*a* and 24*b* or apexes 22*b* and 24*a*) of the first and second angled continuous wires 18 and 20 to within the range of 0.010 inches. Thus, the features described herein can be used to fabricate a metal stud having an accuracy of its length of within in the range of ±0.040 inches, within in the range of ±0.030 inches, or within in the range of ±0.020 inches. It has also been found that the features described herein can be used to fabricate a metal stud having a variation in the pitch of its wire matrix along its length (e.g., a difference between the largest individual pitch and the smallest individual pitch along the length of the stud) that is relatively large, such as at least 1%, at least 2%, at least 3%, at least 4%, or at least 5% of the average (e.g., mean) pitch of the wire matrix over the length of the stud.

A method of continuously fabricating a plurality of metal studs using the assembly line 200 can include receiving an order for a plurality of metal studs having a variety of specific lengths and a variety of specific widths, such as may be requested by a customer, and selecting the specified overall width $W_s$ and the specified overall length $L_s$ for each of the plurality of metal studs to match the dimensions requested by the customer. The method can also include continuously fabricating the two zig-zag wires 204, continuously welding the zig-zag wires 204 to one another to continuously form the continuous wire matrix 208, continuously stretching the continuous wire matrix 208, continuously forming and introducing the continuous elongated channel members 216, and continuously welding the continuous wire matrix 208 to the continuous elongated channel members 216, to continuously form the continuous elongate metal stud 228, in accordance with the features described above for forming an individual metal stud.

As the continuous elongate metal stud 228 travels through the flying shear cutting system 232, the cutting system 232 can cut or singulate the continuous elongate metal stud 228 into a series of individual metal studs, such as a series of metal studs each having the specified overall length $L_s$ and the specified overall width $W_s$ for that respective metal stud. In some cases, the requested stud having the smallest specified degree of stretching can be the first stud to be formed and singulated, with studs of the same specified degree of stretching being formed and singulated immediately thereafter. Once the studs of the smallest specified degree of stretching have been formed, the assembly line 200 can be adjusted to fabricate the requested stud having the second smallest specified degree of stretching. Such an adjustment can be achieved by increasing the forces the first and second conveyors 210 and 226 exert on the continuous wire matrix 208 or by increasing the difference in the speeds at which the first and second processing lines 240 and 242 move the continuous wire matrix 208 through the assembly line 200. Such an adjustment can result in the fabrication of a transition stud having a wire matrix with two different pitches, or with a variable pitch, which in some cases may be scrapped, while in other cases, may be useable as one of the requested studs, depending on the circumstances.

Once the assembly line 200 has been adjusted, all requested studs having the second smallest specified degree of stretching can be fabricated, and the process can be repeated for all of the requested studs. In other cases, the requested stud having the largest specified degree of stretching can be the first stud to be formed and singulated, with studs of deceasing specified degrees of stretching being formed and singulated thereafter, until all of the requested studs have been fabricated. Adjustments of the assembly line 200 can be achieved in such cases by decreasing the forces the first and second conveyors 210 and 226 exert on the continuous wire matrix 208 or by decreasing the difference in the speeds at which the first and second processing lines 240 and 242 move the continuous wire matrix 208 through the assembly line 200.

In some cases, the requested stud having the smallest specified overall length $L_s$ and/or the smallest specified overall width $W_s$ can be the first stud to be formed and singulated, with studs of the same specified overall length $L_s$ and/or the same specified overall width $W_s$ being formed and singulated immediately thereafter. The assembly line 200 can then be adjusted to fabricate the requested stud having the second smallest specified overall length $L_s$ and/or the second smallest specified overall width $W_s$, such as by adjusting the operation of the first and second conveyors 210, 226 to adjust the assembly line 200 to fabricate a stud having a larger specified overall length $L_s$, by adjusting the operation of the flying shear cutting system 232 to cut studs having a larger specified overall length $L_s$, and/or by adjusting the zig-zag wire benders 202 to adjust the assembly line 200 to fabricate a stud having a larger specified overall width W. The process can be repeated for all of the requested studs. In other cases, the requested stud having the largest specified overall length $L_s$, and/or the largest specified overall width $W_s$ can be the first stud to be formed and singulated, with studs of deceasing dimensions being formed and singulated thereafter, until all of the requested studs have been fabricated.

As described above, the features described herein can be used to fabricate the metal stud 10 to have apexes of its first and second angled continuous wires 18 and 20 welded to both ends of the first and second elongated channel members 12 and 14 while having any specified overall length $L_s$ above 8 feet. Such results provide important advantages. For example, by manufacturing metal studs to specific lengths in a factory setting, the need to cut or trim studs to length during installation can be reduced or eliminated, improving installation efficiency.

Further, fabricating metal studs such as metal stud 10 to have apexes of its first and second angled continuous wires 18 and 20 welded to both ends of the first and second elongated channel members 12 and 14 makes the metal stud 10 symmetrical, so that installers can install the stud 10 without regard to which end of the stud is the top or the bottom end of the stud 10, eliminates the sharp ends of the wires 18 and 20 that would otherwise pose hazards during installation, and increases web crippling strengths of the stud 10 at its respective ends. Further, fabricating metal studs such as metal stud 10 to have apexes of its first and second angled continuous wires 18 and 20 welded to both ends of the first and second elongated channel members 12 and 14 facilitates installation of a series of metal studs so that the passages 28 are aligned, or at least more closely aligned, across the series of metal studs.

Figure 11:
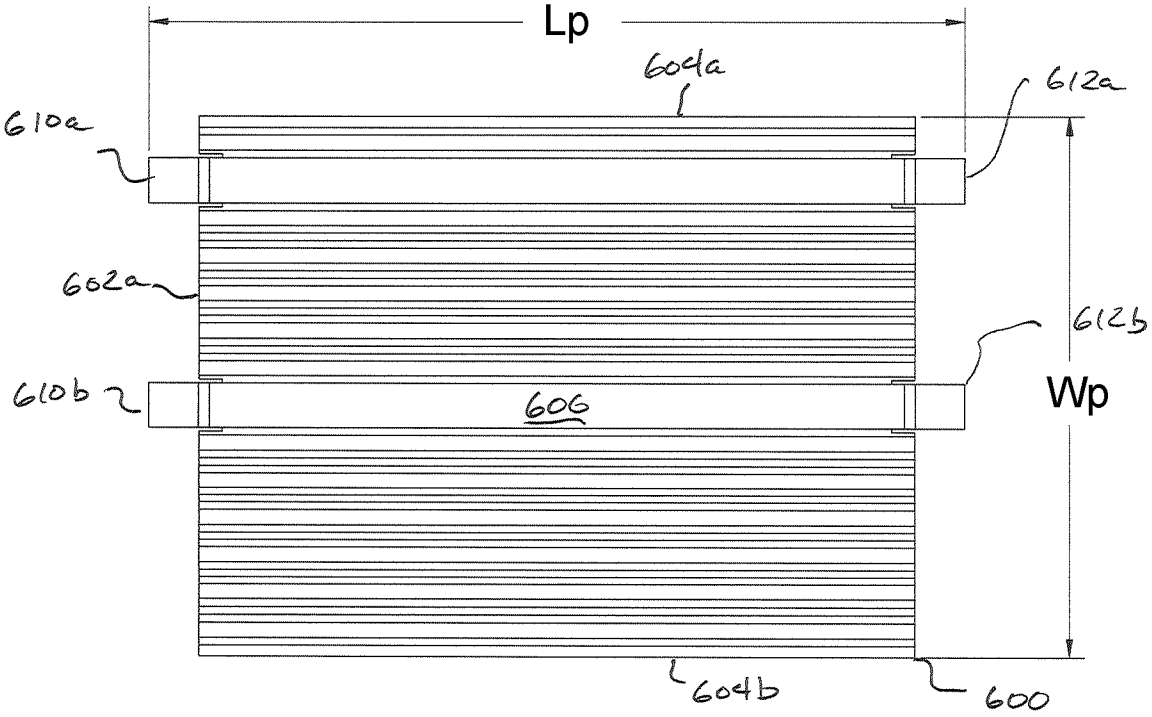
FIG. 11 is a top plan view of the reinforcement plate of FIG. 7 in a flattened configuration, prior to being folded to form upstanding portions or tabs.
Figure 12:
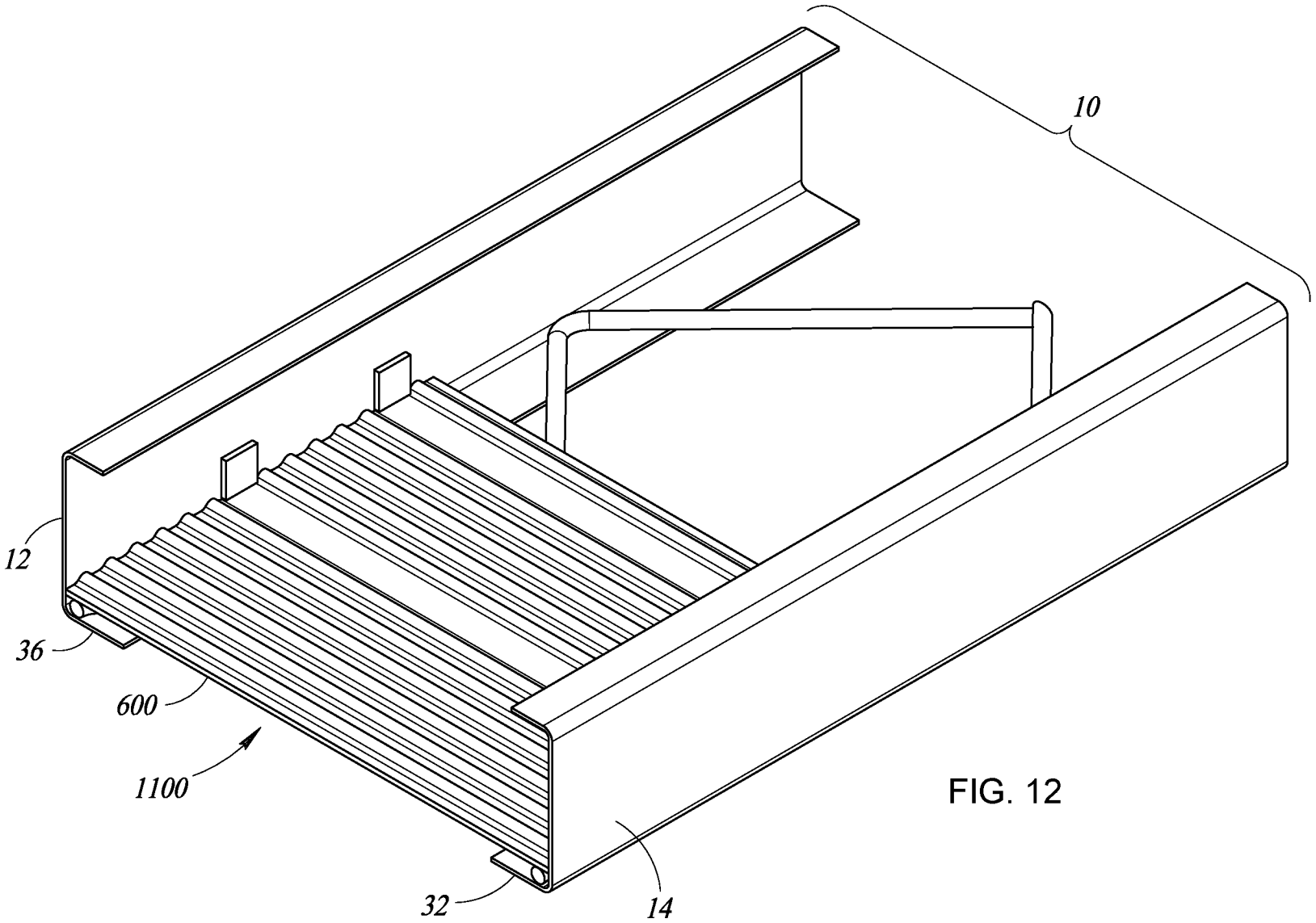
FIG. 12 is a top isometric view of a metal framing member including a metal stud and reinforcement plate physically coupled thereto proximate at least one end thereof, according to at least one illustrated embodiment.
Figure 13:
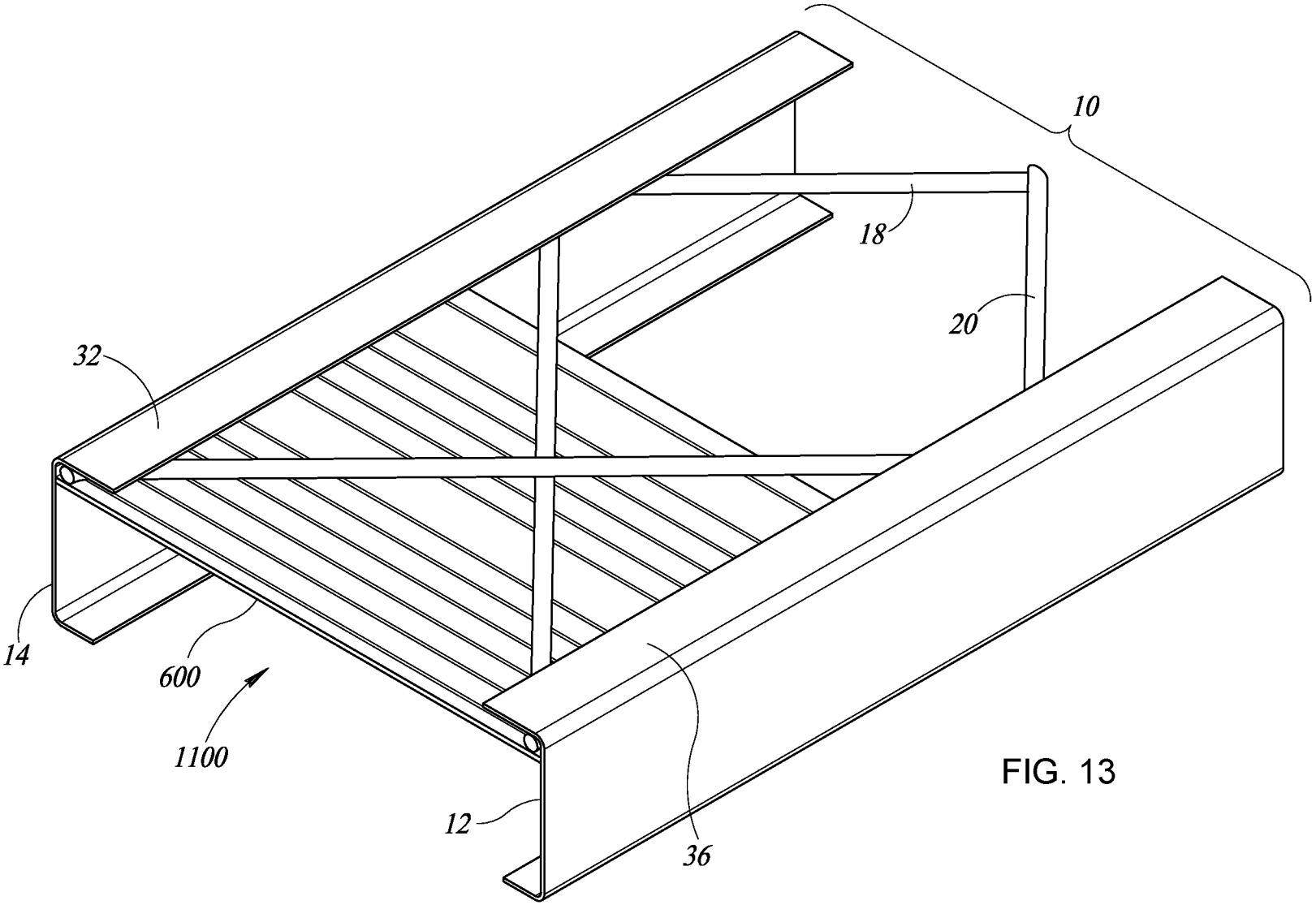
FIG. 13 is a bottom isometric view of the metal framing member of FIG. 12.
Figure 14:
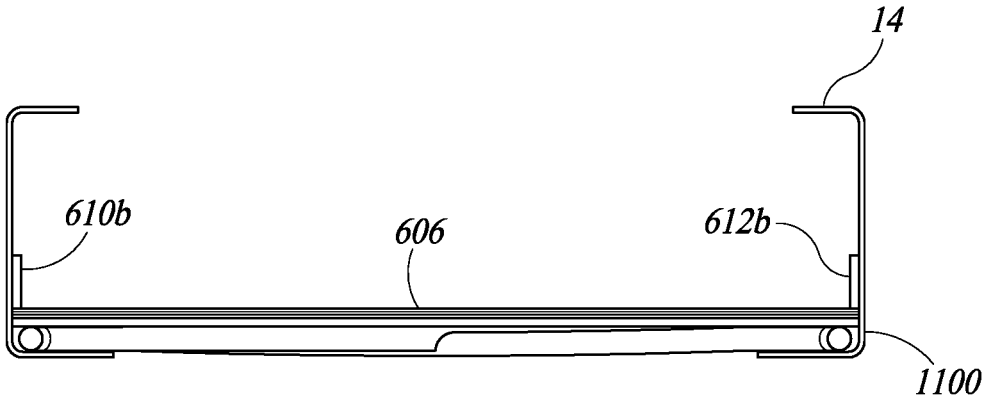
FIG. 14 is an end elevational view of the metal framing member of FIG. 12.
Figure 15:
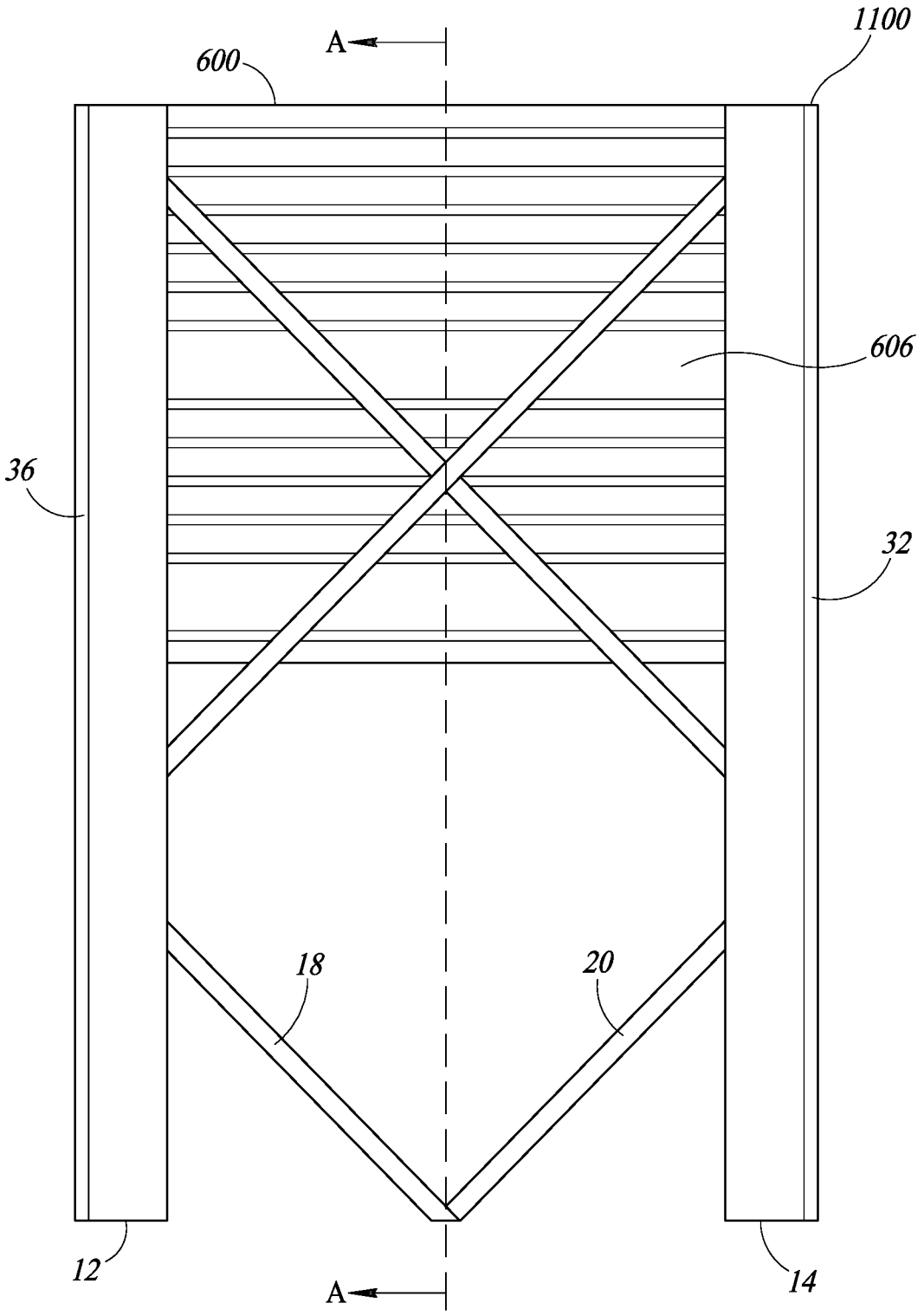
FIG. 15 is a bottom view of the metal framing member of FIG. 12.
Figure 16:
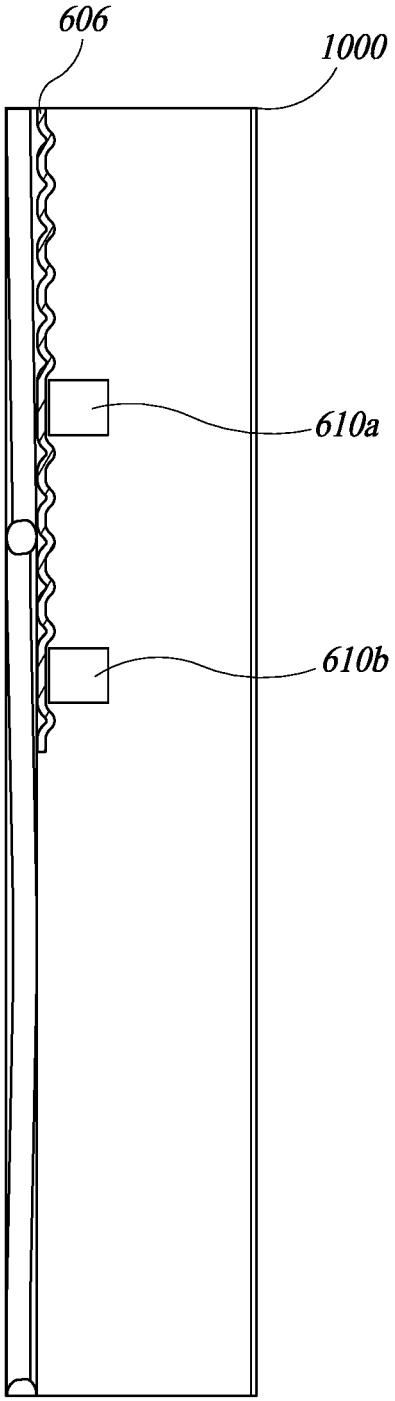
FIG. 16 is a cross-sectional view of the metal framing member of FIG. 12, taken along the section line A-A of FIG. 15.

FIGS. 7-11 show a reinforcement plate 600 for use with the metal stud to fabricate a metal framing member 1100 (FIGS. 12-16), according to at least one illustrated embodiment. In particular, FIG. 11 shows the reinforcement plate 600 in a flattened or unfolded configuration, while FIGS. 7-10 show the reinforcement plate 600 in a folded configuration.

The reinforcement plate 600 may have a rectangular profile, having a length $L_p$ and a width $W_p$, and having a gauge or thickness of material G that is generally perpendicular to the profile and hence the length $L_p$ and the width W. The reinforcement plate 600 has a first pair of opposed edges 602*a*, 602*b*, a second edge 602*b* of the first pair opposed to a first edge 602*a* of the first pair across the length $L_p$ of the reinforcement plate 600. The reinforcement plate 600 has a second pair of opposed edges 604*a*, 604*b*, a second edge 604*b* of the second pair opposed to a first edge 604*a* of the second pair across the width $W_p$ of the reinforcement plate 600.

Between the first and the second pair of opposed edges 602*a*, 602*b*, 604*a*, 604*b* is a center or plate portion 606 of the reinforcement plate 600. The center or plate portion 606 of the reinforcement plate 600 is preferably corrugated, having a plurality of ridges 608*a* and valleys 608*b* (only one of each called out for clarity of illustration), the ridges 608*a* and valleys 608*b* which extend between the first and the second edges 602*a*, 602*b* of the first pair of opposed edges, that is across the length $L_p$ of the reinforcement plate 600. The ridges 608*a* and valleys 608*b* preferably repeat in a direction along which the first and the second edges 602*a*, 602*b* extend, that is repeating along the width $W_p$ of the reinforcement plate 600. The corrugations provide structural rigidity to the reinforcement plate 600. The pattern may be continuous, or as illustrated may be discontinuous, for example omitting ridges 608*a* and valleys 608*b* in sections between pairs of opposed tabs (e.g., opposed pair of tabs 610*a*, 612*a*, and opposed pair of tabs 610*b*, 612*b*).

While first and second edges 602*a*, 602*b* are illustrated as straight edges that extend in a straight line between opposed edges 604*a*, 604*b*, the first and second edges 602*a*, 602*b* can advantageously be notched or serrated to minimize contact between the first and second edges 602*a*, 602*b* and the elongated channel members 12, 14, with contact limited to only a few portions that are fastened or secured directly to the channel members 12, 14, thereby reducing heat transfer.

The reinforcement plate 600 has at least one upstanding portion 610*a*-610*b* along the first edge 602*a* and at least one upstanding portion 612*a*-612*b* along the second edge 602*b*. The upstanding portions 610*a*, 610*b* may take the form of a respective pair of tabs that extend perpendicularly from the plate portion 606 along the first edge 602*a* and a respective pair of tabs that extend perpendicularly from the plate portion 606 along the second edge 602*b*.

As illustrated in FIGS. 12-16, the reinforcement plate 600 can be physically secured to the metal stud 10 via the at least one upstanding portion 610*a*, 610*b* along the first edge 602*a* and the at least one upstanding portion 612*a*, 612*b* along the second edge 602*b*. For example, the reinforcement plate 600 can be welded by welds to the metal stud 10 via the tabs 610*a*, 610*b*, 612*a*, 612*b* that extend perpendicularly from the plate portion 606. For instance, a first set of welds can physically secure the respective pair of tabs 610*a*, 610*b* that extend perpendicularly from the plate portion 606 along the first edge 602*a* to the first flange 32 of the first elongated channel member 12, and a second set of welds can physically secure the respective pair of tabs 612*a*, 612*b* that extend perpendicularly from the plate portion 606 along the second edge 602*b* to the first flange 36 of the second elongated channel member 14.

The reinforcement plate 600 can be physically secured to the metal stud 10 so that the edges 602*a*, 602*b* of the reinforcement plate 600 are within and enclosed by the first and second elongated channels 12 and 14. For example, the first edge 602*a* can be positioned adjacent the major face 30 and between the flanges 32 and 42, and the second edge 602*b* can be positioned adjacent the major face 34 and between the flanges 36 and 44. In such an embodiment, the reinforcement plate 600 can be adjacent to, abutting, and in contact with the wire matrix 16, and can be within or on the inside of the metal stud 10.

In various embodiments, the reinforcement plate 600 can be physically secured, connected, fixed, or coupled to the other components of the metal stud 10 using any suitable mechanisms, methods, fasteners, or adhesives. For example, the reinforcement plate 600 can be physically secured to the other components of the metal stud 10 by an interference fit between the first and second elongated channel members 12, 14, such as between their respective major faces 30 and 34. In such an example, the length $L_p$ of the reinforcement plate 600 can be slightly larger than a distance between the major faces 30 and 34, so that the reinforcement plate 600 is secured by an interference fit between the major faces 30, 34 when positioned between them.

Figure 18:
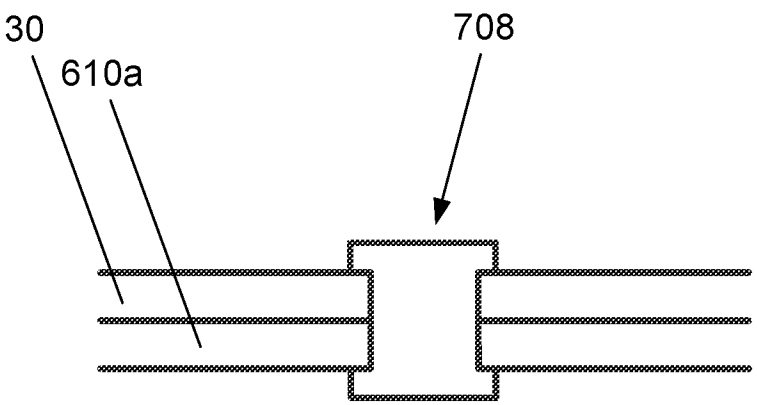
FIG. 18 is a cross-sectional view of two sheets of material having been coupled to one another by a rivet.
Figure 17:
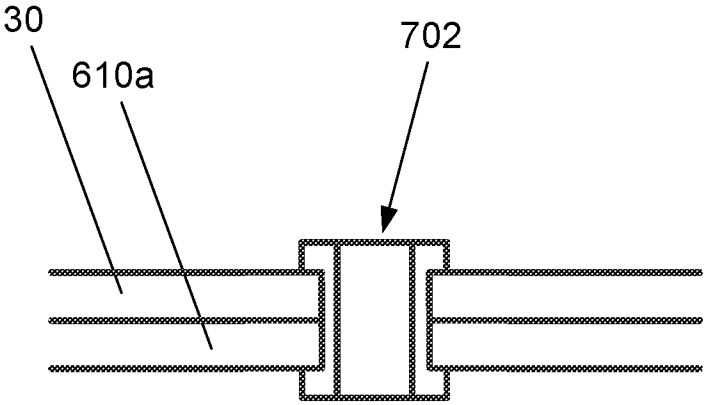
FIG. 17 is a cross-sectional view of two sheets of material having been coupled to one another by swaging or radially cold expanding a bushing assembly.

As another example, the reinforcement plate 600 can be resistance welded to the other components of the metal stud 10. In such an example, the tabs 610*a*, 610*b*, 612*a*, and 612*b* of the reinforcement plate 600 can be resistance welded to the major faces 30 and 34, or the center or plate portion 606 of the reinforcement plate 600 can be resistance welded to the flanges 32 and 36 or to the wire matrix 16. As yet another example, the reinforcement plate 600 can be secured to the other components of the metal stud 10 by swaging or radially cold expanding a bushing or bushing assembly via passage of a tapered mandrel, where the bushing extends through aligned apertures or openings formed in the major faces 30 and 34 and the tabs 610*a*, 610*b*, 612*a*, and 612*b*. For example, FIG. 17 illustrates a bushing assembly 702 that extends through aligned apertures in the tab 610*a* and the major face 30, and that has been swaged or radially cold expanded to secure the tab 610*a* to the major face 30. As yet another example, the reinforcement plate 600 can be secured to the other components of the metal stud 10 by rivets extending through aligned apertures or openings formed in the major faces 30 and 34 and the tabs 610*a*, 610*b*, 612*a*, and 612*b*. For example, FIG. 18 illustrates a rivet 708 that extends through aligned apertures in the tab 610*a* and the major face 30, and that has been used to secure the tab 610*a* to the major face 30.

Figure 19B:
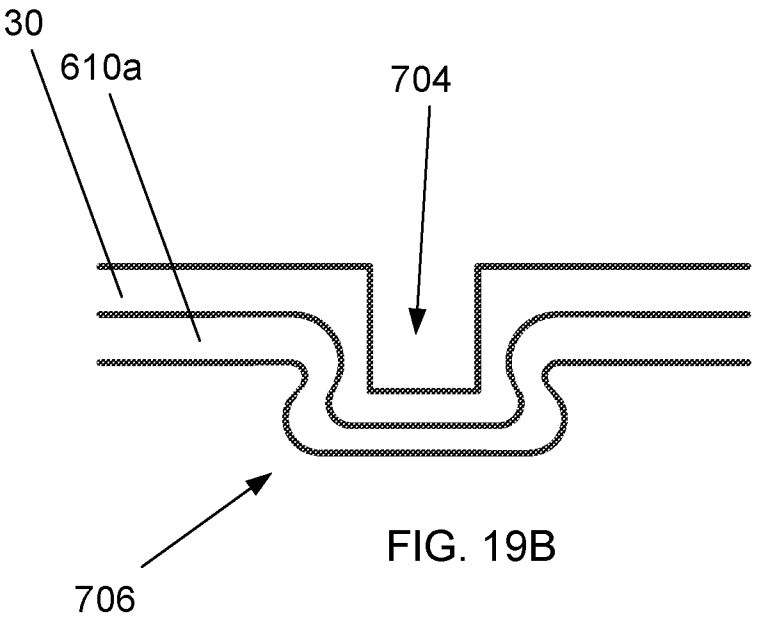
FIG. 19B is a cross-sectional view of the two sheets of material of FIG. 19A, having been clinched or press joined to one another.
Figure 19A:
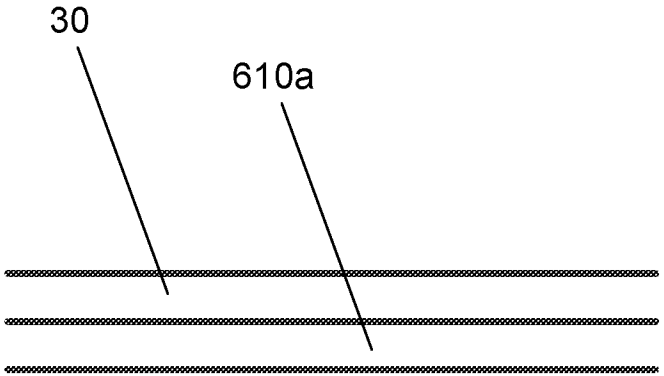
FIG. 19A is a cross-sectional view of two sheets of material to be clinched or press joined to one another.

As another example, the reinforcement plate 600 can be physically secured to the other components of the metal stud 10 by clinching or press joining the reinforcement plate 600 to the first and second elongated channel members 12 and 14. In such an example, the tabs 610*a*, 610*b*, 612*a*, and 612*b* of the reinforcement plate 600 can be clinched to the major faces 30 and 34 of the elongated channel members 12 and 14, or the center or plate portion 606 of the reinforcement plate 600 can be clinched to the flanges 32 and 36 of the elongated channel members 12 and 14. For example, FIG. 19A illustrates the tab 610*a* being positioned adjacent to the major face 30 in preparation for a clinching operation, and FIG. 19B illustrates the tab 610*a* clinched to the major face 30 after the clinching operation is complete. The clinching operation can use a punch to press and deform the tab 610*a* and major face 30 at a location indicated by reference numeral 704 to form an interlocking structure indicated by reference numeral 706 to lock the tab 610*a* to the major face 30. Additional information regarding clinching operations can be found in U.S. Pat. Nos. 8,650,730, 7,694,399, 7,003,861, 6,785,959, 6,115,898, and 5,984,563, and U.S. Pub. Nos. 2015/0266080 and 2012/0117773, all of which are assigned to BTM Corporation.

A first reinforcement plate 600 may be fixed at least proximate or even at a first end of the metal stud 10, and a second reinforcement plate 600 may be fixed at least proximate or even at a second end of the same metal stud 10. The first and second reinforcement plates 600 can be coupled to the other components of the metal stud 10 by any of the mechanisms, methods, fasteners, or adhesives described herein. The first and second reinforcement plates 600 can be coupled to the other components of the metal stud 10 by the same or by different mechanisms, methods, fasteners, or adhesives.

Patent Cooperation Treaty application number PCT/CA2016/050900, published as international publication number WO 2017/015766, and U.S. Provisional Patent Application No. 62/545,366, are hereby incorporated herein by reference, in their entirety.

Those of skill in the art will recognize that many of the methods set out herein may employ additional acts, may omit some acts, and/or may execute acts in a different order than specified.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A stud, comprising:

a first elongated channel member, the first elongated channel member having a respective major face having a respective first edge along a major length thereof and a respective second edge along the major length thereof, a respective first flange extending along the first edge at a non-zero angle to the respective major face of the first elongated channel member, a respective second flange extending along the second edge at a non-zero angle to the respective major face of the first elongated channel member, a respective first end along the major length thereof, and a respective second end along the major length thereof, the first end of the first elongated channel member opposite to the second end of the first elongated channel member across the major length of the first elongated channel member;

a second elongated channel member, the second elongated channel member having a respective major face having a respective first edge along a major length thereof and a respective second edge along the major length thereof, a respective first flange extending along the first edge at a non-zero angle to the respective major face of the second elongated channel member, a respective second flange extending along the second edge at a non-zero angle to the respective major face of the second elongated channel member, a respective first end along the major length thereof, and a respective second end along the major length thereof, the first end of the second elongated channel member opposite to the second end of the second elongated channel member across the major length of the second elongated channel member;

a first continuous wire member having a plurality of bends to form alternating apexes along a respective length thereof, a respective first end along the respective length thereof, and a respective second end along the respective length thereof, the first end of the first continuous wire member opposite to the second end of the first continuous wire member across the length of the first continuous wire member, the apexes of the first continuous wire member alternatively physically attached to the first and the second elongated channel members along at least a portion of the first and the second elongated channel members, the first end of the first continuous wire member coupled to the first elongated channel member at the first end of the first elongated channel member, and the second end of the first continuous wire member coupled to either the first or the second elongated channel member at the second end of either the first or the second elongated channel member; and a second continuous wire member having a plurality of bends to form alternating apexes along a respective length thereof, a respective first end along the respective length thereof, and a respective second end along the respective length thereof, the first end of the second continuous wire member opposite to the second end of the second continuous wire member across the length of the second continuous wire member, the apexes of the second continuous wire member alternatively physically attached to the first and the second elongated channel members along at least a portion of the first and the second elongated channel members, the first end of the second continuous wire member coupled to the second elongated channel member at the first end of the second elongated channel member, the second end of the second continuous wire member coupled to either the first or the second elongated channel member at the second end of either the first or the second elongated channel member, and the first and the second elongated channel members held in spaced apart parallel relation to one another by both of the first and the second wire members, with a longitudinal passage formed therebetween, wherein the first and second continuous wire members form a wire matrix having a pitch and a length, wherein the pitch of the wire matrix varies along the length of the wire matrix such that the first end of the first continuous wire member is coupled to the first elongated channel member at the first end of the first elongated channel member, and the second end of the first continuous wire member is coupled to either the first or the second elongated channel member at the second end of either the first or the second elongated channel member, and the first end of the second continuous wire member is coupled to the second elongated channel member at the first end of the second elongated channel member, and the second end of the second continuous wire member is coupled to either the first or the second elongated channel member at the second end of either the first or the second elongated channel member.

2. The stud of claim 1 wherein the first and the second wire members are physically attached to one another at each point at which the first and the second wire members cross one another.

3. The stud of claim 2 wherein each of the apexes of the second wire member is opposed to a respective one of the apexes of the first wire member across the longitudinal passage.

4. The stud of claim 1 wherein the first and the second continuous wires are physically attached to the respective first flange of both the first and the second elongated channel member by welds and do not physically contact the respective major faces of the first and the second elongated channel members.

5. The stud of claim 4 wherein the welds are resistance welds.

6. The stud of claim 1 wherein the apexes of the first continuous wire member attached to the first elongated channel member alternate with the apexes of the second continuous wire member attached to the first elongated channel member such that a difference between a largest distance between adjacent ones of the apexes of the first and second continuous wires attached to the first elongated channel member and a smallest distance between adjacent ones of the apexes of the first and second continuous wires attached to the first elongated channel member is at least 1% of a mean distance between adjacent ones of the apexes of the first and second continuous wires attached to the first elongated channel member.

7. The stud of claim 1 wherein the first and second continuous wire members are plastically deformed wire members, wherein the first and second continuous wire members are plastically deformed to adjust the pitch of the wire matrix.

8. The stud of claim 1 wherein the first and second continuous wire members carry residual stresses that result from the first and second continuous wire members being coupled to the first and the second elongated channel members under tension.

9. A stud, comprising:

a first elongated channel member, the first elongated channel member having a respective major face having a respective first edge along a major length thereof and a respective second edge along the major length thereof, a respective first flange extending along the first edge at a non-zero angle to the respective major face of the first elongated channel member, and a respective second flange extending along the second edge at a non-zero angle to the respective major face of the first elongated channel member;

a second elongated channel member, the second elongated channel member having a respective major face having a respective first edge along a major length thereof and a respective second edge along the major length thereof, a respective first flange extending along the first edge at a non-zero angle to the respective major face of the second elongated channel member, and a respective second flange extending along the second edge at a non-zero angle to the respective major face of the second elongated channel member;

a first continuous wire member having a plurality of bends to form alternating apexes along a respective length thereof, the apexes of the first continuous wire member alternatively physically attached to the first and the second elongated channel members along at least a portion of the first and the second elongated channel members; and a second continuous wire member having a plurality of bends to form alternating apexes along a respective length thereof, the apexes of the second continuous wire member alternatively physically attached to the first and the second elongated channel members along at least a portion of the first and the second elongated channel members, the apexes of the first continuous wire member attached to the first elongated channel member alternating with the apexes of the second continuous wire member attached to the first elongated channel member such that a difference between a largest distance between adjacent ones of the apexes of the first and second continuous wires attached to the first elongated channel member and a smallest distance between adjacent ones of the apexes of the first and second continuous wires attached to the first elongated channel member is at least 1% of a mean distance between adjacent ones of the apexes of the first and second continuous wires attached to the first elongated channel member, the first and the second elongated channel members held in spaced apart parallel relation to one another by both of the first and the second wire members, with a longitudinal passage formed therebetween.

10. The stud of claim 9 wherein the difference between the largest distance between adjacent ones of the apexes of the first and second continuous wires attached to the first elongated channel member and the smallest distance between adjacent ones of the apexes of the first and second continuous wires attached to the first elongated channel member is at least 2% of the mean distance between adjacent ones of the apexes of the first and second continuous wires attached to the first elongated channel member.

11. The stud of claim 9 wherein the difference between the largest distance between adjacent ones of the apexes of the first and second continuous wires attached to the first elongated channel member and the smallest distance between adjacent ones of the apexes of the first and second continuous wires attached to the first elongated channel member is at least 3% of the mean distance between adjacent ones of the apexes of the first and second continuous wires attached to the first elongated channel member.

12. The stud of claim 9 wherein the difference between the largest distance between adjacent ones of the apexes of the first and second continuous wires attached to the first elongated channel member and the smallest distance between adjacent ones of the apexes of the first and second continuous wires attached to the first elongated channel member is at least 5% of the mean distance between adjacent ones of the apexes of the first and second continuous wires attached to the first elongated channel member.

13. A method of making a metal stud, the method comprising:

providing a first elongated channel member having a respective major face having a respective first edge along a major length thereof and a respective second edge along the major length thereof, a respective first flange extending along the first edge at a non-zero angle to the respective major face of the first elongated channel member, and a respective second flange extending along the second edge at a non-zero angle to the respective major face of the first elongated channel member;

providing a second elongated channel member having a respective major face having a respective first edge along a major length thereof and a respective second edge along the major length thereof, a respective first flange extending along the first edge at a non-zero angle to the respective major face of the second elongated channel member, and a respective second flange extending along the second edge at a non-zero angle to the respective major face of the second elongated channel member;

tensioning a wire matrix including first and second continuous wire members, each of the first and second wire members having a plurality of bends to form alternating apexes along a respective length thereof; and coupling the first and the second elongated channel members together with the tensioned wire matrix, the apexes of the first continuous wire member alternatively physically attached to the first and the second elongated channel members along at least a portion of the first and the second elongated channel members, and the apexes of the second continuous wire member alternatively physically attached to the first and the second elongated channel members along at least a portion of the first and the second elongated channel members.

14. The method of claim 13, further comprising: physically attaching the first and the second continuous wire members to one another at intersection points thereof.

15. The method of claim 14 wherein the physically attaching the first and the second continuous wire members to one another at intersection points thereof occurs before the coupling the first and the second elongated channel members together by the wire matrix.

16. The method of claim 13, wherein tensioning the wire matrix includes tensioning the wire matrix along a longitudinal axis of the wire matrix.

17. The method of claim 13 wherein tensioning the wire matrix includes plastically deforming the wire matrix.

18. The method of claim 13 wherein tensioning the wire matrix includes elastically deforming the wire matrix.

19. A plurality of studs comprising:

a first stud having a first length, the first stud including:

a first elongated channel member, the first elongated channel member having a respective major face having a respective first edge along a major length thereof and a respective second edge along the major length thereof, a respective first flange extending along the first edge at a non-zero angle to the respective major face of the first elongated channel member, a respective second flange extending along the second edge at a non-zero angle to the respective major face of the first elongated channel member, a respective first end along the major length thereof, and a respective second end along the major length thereof, the first end of the first elongated channel member opposite to the second end of the first elongated channel member across the major length of the first elongated channel member;

a second elongated channel member, the second elongated channel member having a respective major face having a respective first edge along a major length thereof and a respective second edge along the major length thereof, a respective first flange extending along the first edge at a non-zero angle to the respective major face of the second elongated channel member, a respective second flange extending along the second edge at a non-zero angle to the respective major face of the second elongated channel member, a respective first end along the major length thereof, and a respective second end along the major length thereof, the first end of the second elongated channel member opposite to the second end of the second elongated channel member across the major length of the second elongated channel member;

a first continuous wire member having a plurality of bends to form alternating apexes along a respective length thereof, a respective first end along the respective length thereof, and a respective second end along the respective length thereof, the first end of the first continuous wire member opposite to the second end of the first continuous wire member across the length of the first continuous wire member, the apexes of the first continuous wire member alternatively physically attached to the first and the second elongated channel members along at least a portion of the first and the second elongated channel members, the first end of the first continuous wire member coupled to the first end of the first elongated channel member, and the second end of the first continuous wire member coupled to the second end of either the first or the second elongated channel member; and a second continuous wire member having a plurality of bends to form alternating apexes along a respective length thereof, a respective first end along the respective length thereof, and a respective second end along the respective length thereof, the first end of the second continuous wire member opposite to the second end of the second continuous wire member across the length of the second continuous wire member, the apexes of the second continuous wire member alternatively physically attached to the first and the second elongated channel members along at least a portion of the first and the second elongated channel members, the first end of the second continuous wire member coupled to the first end of the second elongated channel member, the second end of the second continuous wire member coupled to the second end of either the first or the second elongated channel member, the apexes of the first continuous wire member attached to the first elongated channel member spaced apart from adjacent apexes of the second continuous wire member attached to the first elongated channel member by a first pitch, and the first and the second elongated channel members held in spaced apart parallel relation to one another by both of the first and the second wire members, with a longitudinal passage formed therebetween; and a second stud having a second length, the second stud including:

a third elongated channel member, the third elongated channel member having a respective major face having a respective first edge along a major length thereof and a respective second edge along the major length thereof, a respective first flange extending along the first edge at a non-zero angle to the respective major face of the third elongated channel member, a respective second flange extending along the second edge at a non-zero angle to the respective major face of the third elongated channel member, a respective first end along the major length thereof, and a respective second end along the major length thereof, the first end of the third elongated channel member opposite to the second end of the third elongated channel member across the major length of the third elongated channel member;

a fourth elongated channel member, the fourth elongated channel member having a respective major face having a respective first edge along a major length thereof and a respective second edge along the major length thereof, a respective first flange extending along the first edge at a non-zero angle to the respective major face of the fourth elongated channel member, a respective second flange extending along the second edge at a non-zero angle to the respective major face of the fourth elongated channel member, a respective first end along the major length thereof, and a respective second end along the major length thereof, the first end of the fourth elongated channel member opposite to the second end of the fourth elongated channel member across the major length of the fourth elongated channel member;

a third continuous wire member having a plurality of bends to form alternating apexes along a respective length thereof, a respective first end along the respective length thereof, and a respective second end along the respective length thereof, the first end of the third continuous wire member opposite to the second end of the third continuous wire member across the length of the third continuous wire member, the apexes of the third continuous wire member alternatively physically attached to the third and the fourth elongated channel members along at least a portion of the third and the fourth elongated channel members, the first end of the third continuous wire member coupled to the first end of the third elongated channel member, and the second end of the third continuous wire member coupled to the second end of either the third or the fourth elongated channel member; and a fourth continuous wire member having a plurality of bends to form alternating apexes along a respective length thereof, a respective first end along the respective length thereof, and a respective second end along the respective length thereof, the first end of the fourth continuous wire member opposite to the second end of the fourth continuous wire member across the length of the fourth continuous wire member, the apexes of the fourth continuous wire member alternatively physically attached to the third and the fourth elongated channel members along at least a portion of the third and the fourth elongated channel members, the first end of the fourth continuous wire member coupled to the first end of the fourth elongated channel member, the second end of the fourth continuous wire member coupled to the second end of either the third or the fourth elongated channel member, the apexes of the third continuous wire member attached to the third elongated channel member spaced apart from adjacent apexes of the fourth continuous wire member attached to the third elongated channel member by a second pitch, and the third and the fourth elongated channel members held in spaced apart parallel relation to one another by both of the third and the fourth wire members, with a longitudinal passage formed therebetween;

wherein the first length differs from the second length and the first pitch differs from the second pitch.

20. The plurality of studs of claim 19 wherein the first length differs from the second length by an amount that is not a multiple of either the first pitch or the second pitch.

21. The plurality of studs of claim 19 wherein the first length differs from the second length by 1 inch.

22. The plurality of studs of claim 19 wherein the first length differs from the second length by less than ½ inch.

* * * * *